US007364266B2

(12) United States Patent
Konno

(10) Patent No.: US 7,364,266 B2
(45) Date of Patent: Apr. 29, 2008

(54) LIQUID DROPLET EJECTION APPARATUS

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 55 days.

(21) Appl. No.: 11/365,848

(22) Filed: Mar. 2, 2006

(65) Prior Publication Data

US 2006/0197802 A1 Sep. 7, 2006

(30) Foreign Application Priority Data

Mar. 3, 2005 (JP) ..... 2005-059506

(51) Int. Cl.
*B41J 2/205* (2006.01)

(52) U.S. Cl. ..... 347/43; 347/15

(58) Field of Classification Search ..... 347/12, 347/40, 43, 15, 41, 98, 96, 100
See application file for complete search history.

(56) References Cited

U.S. PATENT DOCUMENTS

| | | | |
|---|---|---|---|
| 6,102,537 A | 8/2000 | Kato et al. | |
| 6,267,476 B1 | 7/2001 | Kato et al. | |
| 6,435,639 B1 | 8/2002 | Nakajima et al. | |
| 6,550,882 B2 * | 4/2003 | Koitabashi et al. | 347/8 |
| 6,554,396 B1 * | 4/2003 | Mizutani | 347/41 |

FOREIGN PATENT DOCUMENTS

| | | |
|---|---|---|
| JP | 8-52867 A | 2/1996 |
| JP | 11-334114 A | 12/1999 |
| JP | 2002-337332 A | 11/2002 |

* cited by examiner

*Primary Examiner*—Lamson Nguyen
(74) *Attorney, Agent, or Firm*—Birch, Stewart, Kolasch & Birch, LLP

(57) ABSTRACT

The liquid droplet ejection apparatus comprises: a first color ink nozzle group in which a plurality of nozzles ejecting ink droplets of a first color are disposed; a second color ink nozzle group in which a plurality of nozzles ejecting ink droplets of a second color are disposed; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of a sub-scanning direction, wherein: the first color ink nozzle group and the second color ink nozzle group are disposed in displaced positions with respect to each other in a main scanning direction; and positions in the main scanning direction of the nozzles of the treatment liquid nozzle group lie between the positions in the main scanning direction of the nozzles of the first color ink nozzle group and the positions in the main scanning direction of the nozzles of the second color ink nozzle group.

10 Claims, 14 Drawing Sheets

LIQUID DROPLET EJECTION APPARATUS

BACKGROUND OF THE INVENTION

1. Field of the Invention

The present invention relates to a liquid droplet ejection apparatus, and more particularly, to a liquid droplet ejection apparatus which forms images on a recording medium by ejecting ink droplets onto the recording medium.

2. Description of the Related Art

An inkjet type liquid droplet ejection apparatus forms images on a recording medium by ejecting ink droplets from a plurality of nozzles (apertures) toward a recording medium, such as paper, while moving the recording medium and an ink ejection head having an arrangement of the nozzles relatively with respect to each other.

In recent years, improvements in image quality have been sought by increasing nozzle density, and hence the amount of ink ejection onto the recording medium has been increasing. Generally, the ink used in a liquid droplet ejection apparatus of this kind has a large content of liquid solvent, such as water, organic solvent, or the like.

If the recording medium is a permeable medium in which the ink permeates into the interior of the medium, so-called "bleeding" arises as the ink permeates into the recording medium, in that the dot size becomes larger than the intended diameter, the boundary regions of the dots become blurred, the spreading of the dots becomes uneven, or the dots form a bearded shape.

Furthermore, even if the recording medium is a non-permeable medium in which the ink becomes fixed principally on the surface of the medium, then if the solvent component in the ink applied to the recording medium is not removed sufficiently, it is not possible to stably fix the coloring material component in the ink on the surface of the recording medium.

Therefore, treatment liquid droplets which cause to the coloring material in the ink droplets to become insoluble or to aggregate, are ejected toward the recording medium, whereupon, ink is ejected and the coloring material is thus caused to aggregate on the recording medium. In particular, if the recording medium is a permeable medium, then the coloring material is made to collect on the surface of the medium, and only the solvent component is made to permeate into the medium. Furthermore, if the recording medium is a non-permeable medium, the coloring material and the solvent are made to separate and only the solvent component is removed. Various liquid droplet ejection apparatuses capable of improving the image quality by adopting compositions of this kind have been proposed.

Japanese Patent Application Publication No. 08-052867 (in particular, FIGS. 4 to 7 and paragraphs 0027 to 0033) discloses an apparatus in which control is implemented in such a manner that treatment liquid dots are formed at the ink dot formation positions, in accordance with the distribution of the ink dots, whereas no treatment liquid dots are formed at positions where no ink dots are to be formed, and furthermore, by making the ejection volume of one droplet of treatment liquid greater than the ejection volume of one droplet of ink, and hence forming the treatment liquid dots to a larger size than the ink dots, one dot of treatment liquid is formed so as to cover the formation region of a plurality of ink dots on the recording medium.

Japanese Patent Application Publication No. 11-334114 (in particular, FIGS. 2 to 7 and paragraphs 0022 to 0031) discloses an apparatus in which quantized data for ink, which are quantized into n values (for example, 5 values) at a prescribed resolution, are determined in accordance with image data, and by assigning ink dots and treatment liquid dots respectively to matrices each comprising a plurality of pixels (for examples, matrices of 2×2 pixels), in accordance with the quantized ink data, the formation positions of the recording liquid dots are controlled in accordance with the state of distribution of the ink dots.

Japanese Patent Application Publication No. 2002-337332 discloses an apparatus which forms high-quality images by depositing droplets in three superimposed layers in the order of: ink, treatment liquid, and ink; or treatment liquid, ink, and treatment liquid.

If droplets of treatment liquid are ejected onto a recording medium, and ink droplets of a first color (for example, magenta), and then ink droplets of a second color (for example, cyan) are ejected in sequence onto the positions on the recording medium where the treatment liquid droplets have been deposited, then the ink droplets of the first color ejected immediately after the treatment liquid droplets make direct contact with the fresh treatment liquid droplets on the recording medium and react satisfactorily with same, whereas the ink droplets of the second color that are ejected subsequently do not make direct contact with the fresh treatment liquid droplets, and in general, the ink droplets of the second color react to a lesser extent than the ink droplets of the first color. In other words, the treatment liquid does not act uniformly on the ink droplets of the first color and the ink droplets of the second color.

Furthermore, if the number of ejection cycles of the treatment liquid is increased in order that the treatment liquid acts uniformly on the ink droplets of the first color and the ink droplets of the second color, in such a manner that droplets are ejected in the order: treatment liquid droplet, first color ink droplet, treatment liquid droplet, and second color ink droplet, onto the same positions on the recording medium, then the amount of treatment liquid deposited on the recording medium increases.

Even if a composition is adopted in which treatment liquid dots are formed at ink dot formation positions and treatment liquid dots are not formed at position where ink dots are not to be formed, on the basis of the state of distribution of the ink dots, as described in Japanese Patent Application Publication No. 08-052867, then in cases where an. image is to be formed over the whole surface of a broad recording medium, ultimately, a large amount of treatment liquid is deposited on the recording medium. For example, if a large photographic image is to be formed on a recording medium, then ultimately, a large amount of treatment liquid is deposited on the recording medium, in any case.

Moreover, even if the treatment liquid dot formation positions are controlled on the basis of quantized ink data, as described in Japanese Patent Application Publication No. 11-334114, in cases where the level of the quantized data corresponding to the amount of treatment liquid to be deposited per unit surface area (for example, a matrix of 2×2 pixels) is high, then ultimately, a large amount of treatment liquid is deposited. If inks of a plurality of colors are used, then in general, a very large amount of treatment liquid is deposited when an image is formed over the whole surface of the medium at a neutral color tone.

Furthermore, none of Japanese Patent Application Publication Nos. 08-052867, 11-334114 and 2002-337332, describes causing the treatment liquid to act uniformly on ink droplets of a first color and ink droplets of a second color.

SUMMARY OF THE INVENTION

The present invention has been contrived in view of the aforementioned circumstances, an object thereof being to provide a liquid droplet ejection apparatus which is able to make treatment liquid droplets act uniformly on respective ink droplets of a plurality of colors on a recording medium, while restricting the amount of treatment liquid deposited on the recording medium.

In order to attain the aforementioned object, the present invention is directed to a liquid droplet ejection apparatus, comprising: a first color ink nozzle group in which a plurality of nozzles ejecting ink droplets of a first color are disposed; a second color ink nozzle group in which a plurality of nozzles ejecting ink droplets of a second color are disposed; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of a sub-scanning direction, wherein: the first color ink nozzle group and the second color ink nozzle group are disposed in displaced positions with respect to each other in a main scanning direction; and positions in the main scanning direction of the nozzles of the treatment liquid nozzle group lie between the positions in the main scanning direction of the nozzles of the first color ink nozzle group and the positions in the main scanning direction of the nozzles of the second color ink nozzle group.

In order to attain the aforementioned object, the present invention is also directed to a liquid droplet ejection apparatus, comprising a first stage of nozzle arrangement and a second stage of nozzle arrangement, the first and second stages being disposed in a sub-scanning direction, each of the first and second stages including: a first color ink nozzle group in which a plurality of nozzles ejecting ink droplets of a first color are disposed at a nozzle pitch which is twice a recording dot pitch in a main scanning direction; a second color ink nozzle group in which a plurality of nozzles ejecting ink droplets of a second color are disposed at the nozzle pitch which is twice the recording dot pitch in the main scanning direction; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of the sub-scanning direction, wherein, in each of the first and second stages, the nozzles of the first color ink nozzle group and the nozzles of the second color ink nozzle group are disposed so as to be mutually complementary in the main scanning direction, to cover all of droplet deposition points in the main scanning direction.

Here, the first color and the second color of the ink droplets are two different colors, and there are no particular restrictions on the colors. If an image is formed by using a greater number of colors than two colors, then the composition of the present invention may be used in respect of the two colors forming the combination that has the greatest probability of being deposited onto substantially the same positions on the recording medium, or the composition of the present invention may be used in respect of the two colors having the highest visibility to a human observer.

For example, if an image is formed by using four colors of magenta, cyan, yellow and black, then the composition according to the present invention may be used with respect to the ink droplets of the two colors of the combination of magenta and cyan, which have a high probability of being deposited on substantially the same positions on the recording medium, and which have a high visibility to the human eye. Furthermore, if inks of light magenta and light cyan are included, as well as magenta and cyan, then at the same time as using the composition according to the present invention in respect of the two colors of the combination of magenta and cyan, it is also possible to use the composition according to the present invention in respect of the two colors of the combination of light magenta and light cyan.

The treatment liquid is a liquid which imparts an effect of some kind on the ink when it makes contact with the ink. For example, a treatment liquid is used which has the effect of separating the solvent and the coloring material in the ink, by causing the coloring material in the ink to become insoluble or to aggregate. For example, a transparent liquid containing cationic polymer is used as the treatment liquid for an ink containing anionic polymer or anionic dye. Furthermore, in the case of a dispersed pigment type of ink, a transparent liquid containing multivalent metal ions is used as a treatment liquid. The treatment liquid is not limited in particular to one which reacts itself with the ink, and the treatment liquid may also be one which has an action of accelerating or halting a reaction of some kind in the ink on the recording medium.

The nozzle groups are not limited to cases where each of the nozzle groups is formed physically in a discrete head, and they also include cases where a plurality of nozzle groups are integrated and formed into a single head.

By means of this composition, compared to the case of the related art where a first color ink nozzle group and a second color ink nozzle group are disposed in substantially the same positions in the main scanning direction, it is possible to make an ink droplet of the first color and an ink droplet of the second color come into contact reliably and uniformly with the same treatment liquid droplet on the recording medium, by ejecting treatment liquid before the ejection of the first color ink droplets only, rather than ejecting treatment liquid both before the ejection of the first color ink droplets and before the ejection of the second color ink droplets.

Preferably, in each of the first and second stages, the first color ink nozzle group and the second color ink nozzle group are disposed in staggered positions. By means of this composition, it is possible to compose the first color nozzle group and the second color nozzle group, respectively and independently, and therefore, the structure of the ink supply system can be simplified.

Alternatively, it is also preferable that, in each of the first and second stages, the nozzles of the first color ink nozzle group and the nozzles of the second color ink nozzle group are disposed in an alternating fashion on a single straight line running in the main scanning direction.

Preferably, positions in the main scanning direction of the nozzles of the treatment liquid nozzle group lie between positions in the main scanning direction of the nozzles of the first color ink nozzle group and positions in the main scanning direction of the nozzles of the second color ink nozzle group; and the nozzles of the treatment liquid nozzle group are disposed at a nozzle pitch which is twice the recording dot pitch in the main scanning direction.

By means of this composition, it is possible to reduce the ejection volume of the treatment liquid, and therefore heads of a low nozzle density can be used.

In order to attain the aforementioned object, the present invention is also directed a liquid droplet ejection apparatus, comprising n stages of nozzle arrangements, the n stages being disposed in a sub-scanning direction, each of the n stages including: a first color ink nozzle group in which a plurality of nozzles ejecting ink droplets of a first color are disposed at a nozzle pitch which is n times a recording dot pitch in a main scanning direction; a second color ink nozzle group in which a plurality of nozzles ejecting ink droplets of a second color are disposed at the nozzle pitch which is n times the recording dot pitch in the main scanning direction; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of the sub-scanning direction, wherein, in each of the n stages, the nozzles of the first color ink nozzle group and the nozzles of the second color ink nozzle group are disposed so as to be displaced with respect to each other by the recording dot pitch in the main scanning direction.

Preferably, the nozzles of the first color ink nozzle group and the second color ink nozzle group are disposed so as to be mutually complementary to form, when all of the nozzles in the n stages that eject ink of a same color are projected to a straight line running in the main scanning direction, a single virtual nozzle line on the straight line having a nozzle pitch equal to the recording dot pitch.

Preferably, positions in the main scanning direction of the nozzles of the treatment liquid nozzle group lie between positions in the main scanning direction of the nozzles of the first color ink nozzle group and positions in the main scanning direction of the nozzles of the second color ink nozzle group; and the nozzles of the treatment liquid nozzle group are disposed at a nozzle pitch which is n times the recording dot pitch in the main scanning direction.

In order to attain the aforementioned object, the present invention is also directed a liquid droplet ejection apparatus, comprising: a first stage having an ink nozzle group in which a plurality of nozzles ejecting ink droplets of a first color are disposed; and a second stage having an ink nozzle group in which a plurality of nozzles ejecting ink droplets of a second color are disposed, wherein: in each of the first and second stages, a treatment liquid nozzle group in which a plurality of nozzles ejecting droplets of a prescribed treatment liquid are disposed are provided on an upstream side of the ink nozzle group in the stage in terms of a sub-scanning direction; and in each of the first and second stages, positions in a main scanning direction of the nozzles of the treatment liquid nozzle group lie between positions in the main scanning direction of the nozzles that are mutually adjacent in the main scanning direction in the ink nozzle groups of the same stage.

Preferably, in each of the first and second stages, the ink nozzle group is disposed by being divided into two ink nozzle sub-groups in the sub-scanning direction; and in each of the first and second stages, the positions in the main scanning direction of the nozzles of the treatment liquid nozzle group lie between the positions in the main scanning direction of the nozzles belonging to one of the two ink nozzle sub-groups in the same stage, and the positions in the main scanning direction of the nozzles belonging to the other of the two ink nozzle sub-groups in the same stage.

According to the present invention, it is possible to cause treatment liquid to act uniformly on ink droplets of a plurality of colors on a recording medium, while restricting the amount of treatment liquid deposited onto the recording medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
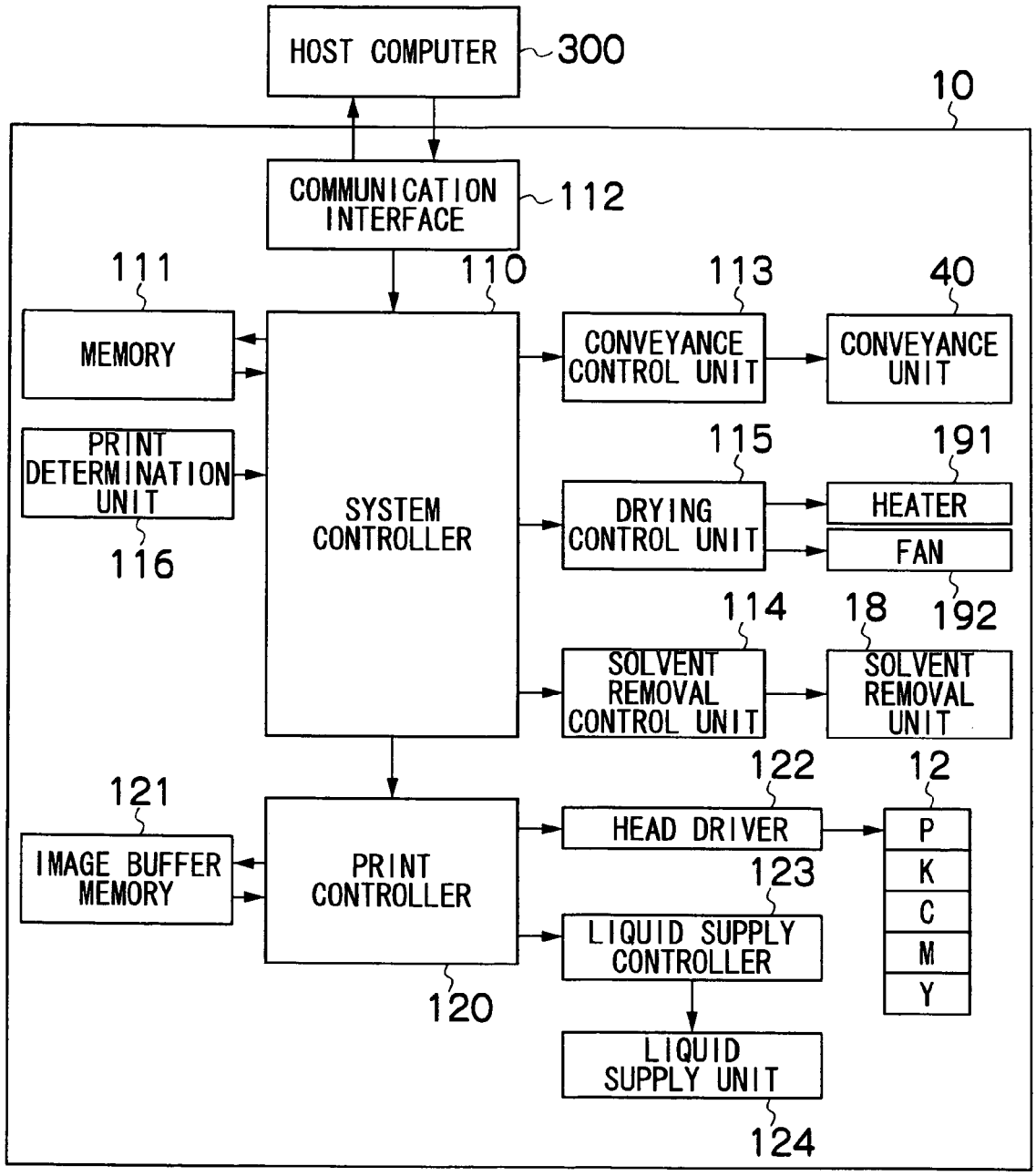
FIG. 1 is a block diagram showing an example of the general composition of a liquid droplet ejection apparatus according to an embodiment of the present invention.

FIG. 1 is a block diagram showing an example of the general composition of a liquid droplet ejection apparatus according to the present invention.

In FIG. 1, the inkjet recording apparatus 10 forming the liquid droplet ejection apparatus of the present embodiment comprises a liquid droplet ejection unit 12, a system controller 110, a memory 111, a communication interface 112, a conveyance control unit 113, a solvent removal control unit 114, a drying control unit 115, a print determination unit 116, a print controller 120, an image buffer memory 121, a head driver 122, a liquid supply control unit 123, a liquid supply unit 124, and the like.

The liquid droplet ejection unit 12 ejects ink droplets and treatment liquid droplets onto a recording medium, such as paper.

The ink is a dye-based ink in which a coloring material is dissolved in a liquid solvent in a molecular state (or an ion state), or a pigment-based ink in which a coloring material is dispersed in a liquid solvent in a state of very fine lumps, or the like.

Furthermore, in the present specification, the treatment liquid is a liquid which imparts an action of some kind to the ink when it makes contact with the ink. For example, a treatment liquid is used which has an action of separating the solvent and coloring material in the ink, by causing the coloring material in the ink to become insoluble or to aggregate. For instance, a transparent liquid containing cationic polymer is used as a treatment liquid with respect to ink containing anionic polymer or anionic dye. Furthermore, for example, a transparent liquid containing multivalent metal ions is used as a treatment liquid for a dispersed pigment type of ink. The treatment liquid is not limited in particular to one which reacts itself with the ink, and the treatment liquid may also be one which has an action of accelerating or halting a reaction of some kind in the ink on the recording medium.

The communication interface 112 is an interface unit for receiving image data transmitted by a host computer 300. The communication interface 112 uses, for example, a wired communication interface, such as USB (Universal Serial Bus), IEEE 1394, Ethernet, or the like, or a wireless communication interface.

Image data sent from the host computer 300 is read into the inkjet recording apparatus 10 through the communication interface 112, and is stored temporarily in the memory 111. The memory 111 is a storage device for temporarily storing image data inputted through the communication interface 112, and data is written to and read from the memory 111 through the system controller 110. The memory 111 is not limited to a memory constituted by semiconductor elements, and a magnetic recording medium such as a hard disk, or an optical recording medium such as an optical disk, may also be used.

There are no particular limitations on the image data input mode, provided that image data is inputted by means of communications with the host computer 300. For example, it is also possible to input image data by reading in image data from a removable media, such as a memory card or optical disk.

The system controller 110 is constituted by a central processing device (CPU) and peripheral circuits thereof, and the like, and it functions as a control device for controlling the whole of the inkjet recording apparatus 10 in accordance with a prescribed program, as well as a calculation device for performing various calculations. The system controller 110 controls the various sections, such as the memory 111, the communication interface 112, the conveyance control unit 113, the solvent removal control unit 114, the drying control unit 115, the print determination unit 116, the print controller 120, and the like. For example, as well as controlling communications with the host computer 300, it also controls the conveyance unit 40 such as a conveyance motor through the conveyance control unit 113, the solvent removal unit 18 such as a solvent removal roller through the solvent removal control unit 114, a heater 191 and a blower fan 192 through the drying control unit 115, and the head driver 122 and the liquid supply control unit 123 through the print controller 120.

The program executed by the system controller 110 and the various types of data which are required for control procedures are stored in the memory 111. Furthermore, the memory 111 is used as a temporary storage region for the image data, and it is also used as a program development region and a calculation work region for the CPU.

The conveyance control unit 113 is a driver (drive circuit) which drives the conveyance unit 40, such as a conveyance motor, in accordance with instructions from the system controller 110.

The conveyance unit 40 conveys the recording medium along a prescribed conveyance path. For example, the conveyance unit 40 comprises a conveyance belt on which the recording medium is held by suction, and conveyance rollers which drive the conveyance belt. The conveyance unit 40 is controlled by the conveyance control unit 113, and the conveyance unit 40 causes the recording medium and the liquid droplet ejection unit 12 to move relatively with respect to each other, in the direction of conveyance of the recording medium (the sub-scanning direction).

The solvent removal control unit 114 is a driver (drive circuit) which drives the solvent removal unit 18, such as a solvent removal roller, in accordance with instructions from the system controller 110.

The solvent removal unit 18 removes liquid from the recording medium on which the treatment liquid and ink have been deposited. Here, the liquid removed from the recording medium is chiefly a solvent that has been separated from the coloring material in the ink on the recording medium, by the action of the treatment liquid. If the treatment liquid is remaining on the recording medium, then the remaining treatment liquid is also removed from the recording medium. A concrete example of the solvent removal unit 18 is described in detail later.

The drying control unit 115 is a driver (drive circuit) which drives the heater 191 and the blower fan 192, in accordance with instructions from the system controller 110.

The print determination unit 116 is a block including an image sensor, which reads in the image printed on the recording medium, performs various signal processing operations, and the like, and determines the print situation (presence/absence of ejection, variation in droplet ejection, optical density, and so on). The print determination unit 116 supplies these determination results to the system controller 110.

The print controller 120 is a control unit having a signal processing function for performing various treatment processes, corrections, and the like, in accordance with the control implemented by the system controller 110, in order to generate signals for controlling printing from the image data in the memory 111. The print controller 120 supplies the print data (dot data) thus generated to the head driver 122.

The print controller 120 is provided with the image buffer memory 121; and image data, parameters, and other data are temporarily stored in the image buffer memory 121 when image data is processed in the print controller 120. The aspect shown in FIG. 1 is one in which the image buffer memory 121 accompanies the print controller 120; however, the memory 111 for the system controller 110 may also serve as the image buffer memory 121. Also possible is an aspect in which the print controller 120 and the system controller 110 are integrated to form a single processor.

The image data to be printed on the recording medium is externally inputted through the communication interface 112, and is stored in the memory 111. At this stage, RGB image data is stored in the memory 111. The image data stored in the memory 111 is sent to the print controller 120 through the system controller 110, and is converted to the dot data for each ink color by a half-toning technique, such as dithering or error difflusion, in the print controller 120. In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible.

In other words, the print controller 120 performs processing for converting the input RGB image data into dot data for the four colors of K, C, M and Y. Furthermore, the print controller 120 judges the droplet deposition region of the treatment liquid (the region of the recording surface where deposition of treatment liquid is required) on the basis of the dot data of the respective colors, and thus generates dot data for the ejection of treatment liquid droplets. The dot data (for the treatment liquid and the respective colors of ink) generated by the print controller 120 are stored in the image buffer memory 121.

The head driver 122 generates drive control signals for the liquid droplet ejection head 12P for ejecting treatment liquid droplets and the liquid droplet ejection heads 12K, 12C, 12M and 12Y of the respective ink colors, on the basis of the print data supplied from the print controller 120 (in other words, the dot data stored in the image buffer memory 121). By supplying the drive control signals generated by the head driver 122, to the respective liquid droplet ejection heads 12P, 12K, 12M, 12C and 12Y, treatment liquid is ejected from the nozzles corresponding to the liquid droplet ejection head 12P for ejecting treatment liquid, and ink is ejected from the nozzles corresponding to the liquid droplet ejection heads 12K, 12M, 12C and 12Y for the inks of respective colors. A feedback control system for maintain uniform driving conditions may also be incorporated into the head driver 122.

The liquid supply control unit 123 controls the supply of treatment liquid and ink to the liquid droplet ejection unit 12.

The liquid supply unit 124 supplies treatment liquid to the liquid droplet ejection head 12P for treatment liquid, in accordance with control by the liquid supply control unit 123, as well as supplying ink of respective colors to the liquid droplet ejection heads 12K, 12M, 12C and 12Y of the respective ink colors. The liquid supply unit 124 comprises tubing channels which lead to the liquid droplet ejection unit 12 from an ink storage section (not shown), such as an ink cartridge, installed detachably in the inkjet recording apparatus 10, and a pump and the like. Treatment liquid and ink are supplied by the liquid supply unit 124 from the ink storage unit, such as an ink cartridge, to the liquid droplet ejection unit 12.

By controlling the ejection of treatment liquid from the liquid droplet ejection head 12P for ejecting treatment liquid, and controlling the ejection of ink from the liquid droplet ejection heads 12K, 12M, 12C and 12Y for ejecting ink, in accordance with the conveyance speed of the recording medium, an image is formed on the recording medium. As described above, prescribed signal processing is carried out in the print controller 120, and the ejection of the treatment liquid, and the ejection amount and the ejection timing of the ink droplets are controlled via the head driver 122. By this means, prescribed dot size and dot positions can be achieved.

Furthermore, according to requirements, the print controller 120 performs various corrections relating to the liquid droplet ejection heads 12P, 12K, 12M, 12C and 12Y, on the basis of the information obtained from the print determination unit 116 through the system controller 110. Furthermore, in accordance with instructions from the system controller 110, the print controller 120 implements control for adjusting the volume ratio of the treatment liquid and the ink, on the basis of the information obtained from the print determination unit 116, as well as implementing control for performing prescribed restoration processes, such as preliminary ejection, suction, and the like.

Below, liquid droplet ejection apparatuses according to various embodiments of the present invention are separately described.

A liquid droplet ejection apparatus according to the first embodiment of the present invention is hereby described.

Figure 2:
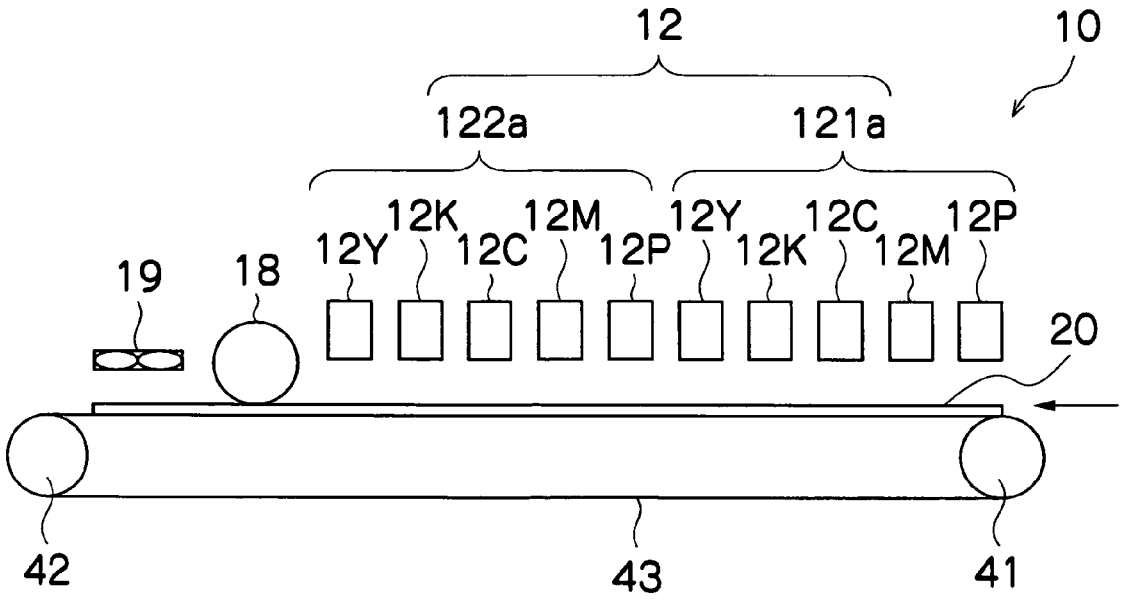
FIG. 2 is a schematic drawing showing the functional composition of the principal sections of a liquid droplet ejection apparatus according to a first embodiment.

FIG. 2 shows an example of the functional composition of the principal sections of the liquid droplet ejection apparatus according to the first embodiment.

The conveyance belt 43 has a width that is greater than the width of the recording medium (the length of the recording medium in the main scanning direction), and conveys the recording medium 20 in a prescribed conveyance direction (sub-scanning direction) while attracting the recording medium. By means of the recording medium 20 being attracted to and conveyed by the conveyance belt 43, bending and wrinkling of the recording medium 20 is prevented. There are various different modes for attracting the recording medium 20, and electrostatic attraction or suction by negative pressure, or the like, can be employed.

The drive force of a motor (not shown) is transmitted to at least one of the conveyance rollers 41, 42 about which the conveyance belt 43 is wound, thereby driving the conveyance belt 43 in the counterclockwise direction in FIG. 2. Accordingly, the recording medium 20 held on the belt 43 is conveyed from right to left in FIG. 2.

The conveyance rollers 41 and 42, the conveyance belt 43 and the conveyance motor constitute the conveyance unit 40 shown in FIG. 1.

The liquid droplet ejection unit 12 according to the first embodiment is constituted in two stages: a first stage 121*a* on the upstream side, and a second stage 122*a* on the downstream side, disposed in the conveyance direction of the recording medium 20 (the sub-scanning direction).

In each of the first stage 121*a* and the second stage 122*a*, a treatment liquid ejection head 12P which ejects treatment liquid droplets, a magenta (M) ink ejection head 12M which ejects magenta ink droplets, a cyan (C) ink ejection heads 12C which ejects cyan ink droplets, a black (K) ink ejection head 12K which ejects black ink droplets, and a yellow (Y) ink ejection head 12Y which ejects yellow ink droplets, in order in the sub-scanning direction, from the upstream side.

The ejection heads 12M, 12C, 12Y, 12B and 12P are disposed in such a manner that they extend in a direction substantially perpendicular to the conveyance direction of the recording medium 20 (sub-scanning direction).

According to this configuration of heads, in the first stage 121*a* and the second stage 122*a*, treatment liquid can be deposited onto the recording surface of the recording medium by a treatment liquid ejection head 12P, before ink droplets are deposited by the ink ejection heads 12M, 12C, 12Y and 12K of the respective colors, namely, magenta, cyan, yellow and black.

The solvent removal unit 18 is constituted by a solvent removing roller, and the like, which absorbs and removes the solvent component that is separated from the coloring material in the ink. Furthermore, it is preferable that the solvent removal unit 18 can be detached when solvent removal is not necessary.

The drying unit 19 heats the recording medium on which the treatment liquid and the ink have been deposited, and evaporates the liquid solvent that is separated from the coloring material in the ink due to the action of the treatment liquid on the recording medium. The drying unit 19 is constituted by the heater 191 (for example, a halogen heater) and the blower fan 192 as shown in FIG. 1. Thereby, the recording medium is dried and the coloring material in the ink is fixed stably on the recording medium.

Below, a case where the ink ejection heads 12M, 12C, 12Y and 12K and the treatment liquid ejection head 12P have a common structure is described as an example.

Figure 3A:
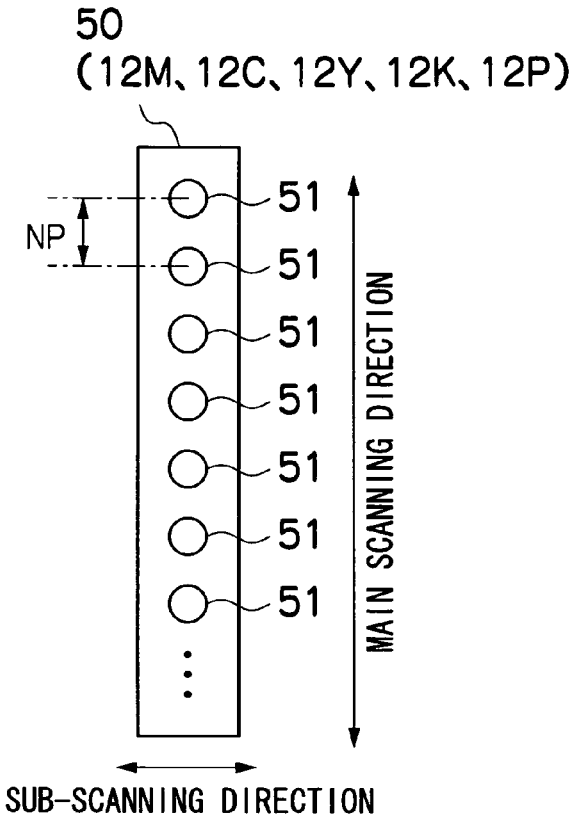
FIGS. 3A, 3B and 3C are schematic drawings showing the basic composition of nozzle groups.
Figure 3B:
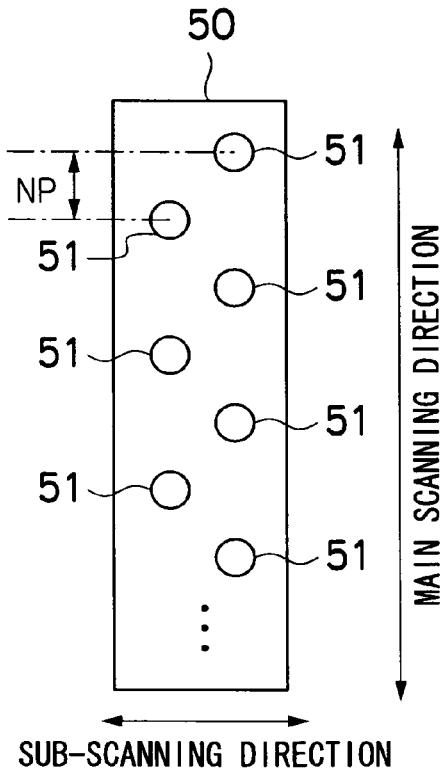
Figure 3C:
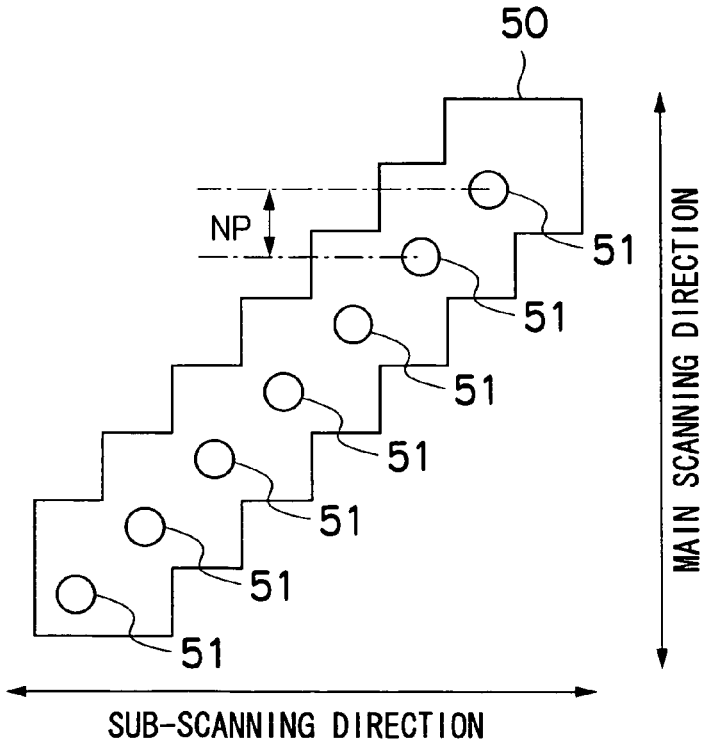

FIGS. 3A, 3B and 3C show the surfaces opposing a recording medium 20 of a liquid droplet ejection head 50 which is a representative example of the ink ejection heads 12M, 12C, 12Y and 12K, and the treatment liquid ejection head 12P having a common structure.

FIG. 3A shows a nozzle arrangement of a basic composition in which a plurality of nozzles 51 are disposed at a prescribed nozzle pitch NP in the main scanning direction; FIG. 3B shows a nozzle arrangement in which a plurality of nozzles 51 are arranged in a staggered matrix in such a manner that the prescribed nozzle pitch NP is achieved in the main scanning direction; and FIG. 3C shows a nozzle arrangement in which a plurality of nozzles 51 are arranged in an oblique direction with respect to the main scanning direction, in such a manner that the prescribed nozzle pitch NP is achieved in the main scanning direction.

Here, the nozzle pitch NP is the interval between the nozzles 51 in the main scanning direction.

Figure 4:
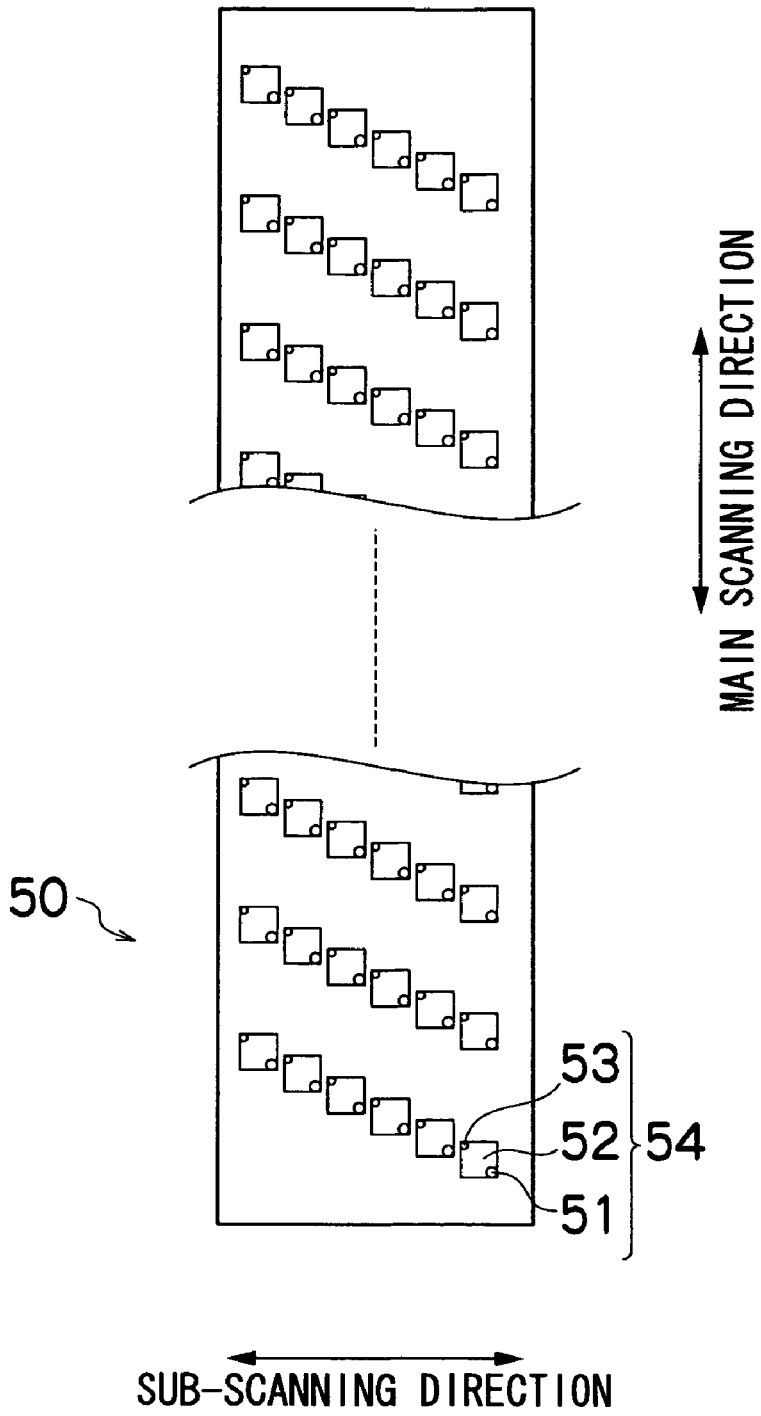
FIG. 4 is a schematic drawing showing a nozzle group arranged in a two-dimensional matrix array.

In the case of the nozzle arrangements shown in FIGS. 3B and 3C, the liquid droplet ejection head 50 having the small nozzle pitch NP can be manufactured readily, in comparison with the nozzle arrangement of the basic composition shown in FIG. 3A. For example, FIG. 4 is a plan view perspective diagram showing an example of the structure of the ejection head 50 in this case, in which the apparent nozzle pitch is reduced by arranging ink chamber units 54, each comprising a nozzle 51, a pressure chamber 52 connected to the nozzle 51, and an ink supply port 53 for supplying ink to the pressure chamber 52, in a staggered matrix.

Figure 5:
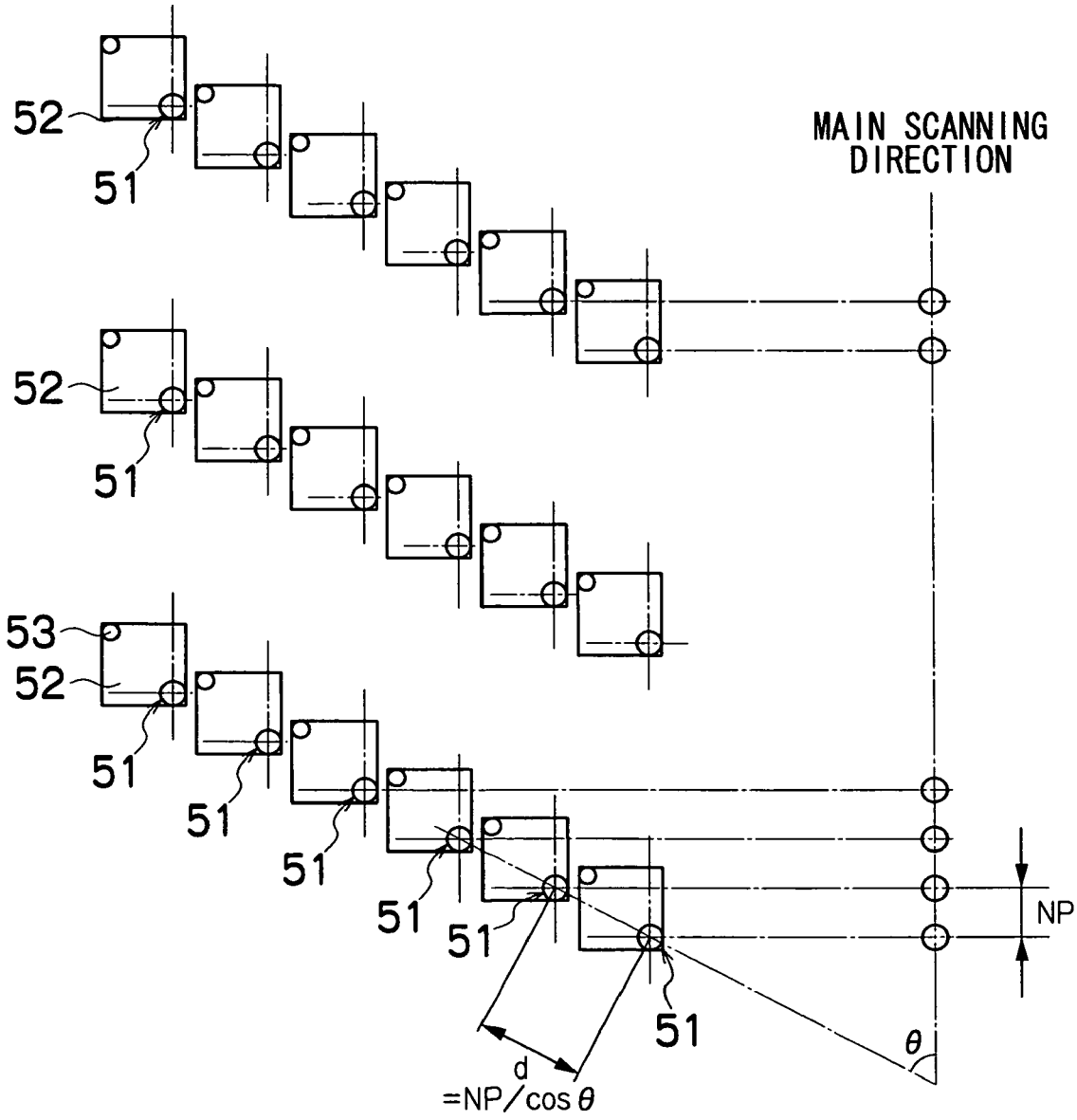
FIG. 5 is a schematic drawing showing an enlarged view of a portion of the nozzle group arranged in the two-dimensional matrix array shown in FIG. 4.

The liquid droplet ejection heads 50 shown in FIGS. 3B and 3C can be treated as the same with the liquid droplet ejection head 50 shown in FIG. 3A, when all of the nozzles are projected to a single line in the main scanning direction. Furthermore, the matrix type head shown in FIG. 4 can be treated as the same with the liquid droplet ejection head in FIG. 3A, as shown in FIG. 5. More specifically, in any one of the liquid droplet ejection heads 50 shown in FIGS. 3A, 3B, 3C and 4, the plurality of nozzles 51 can be arranged at the prescribed nozzle pitch NP in the main scanning direction.

Below, the liquid droplet ejection head 50 shown in FIG. 3A is taken to be a representative example of the liquid droplet ejection head 50 comprising a group of nozzles having the nozzle pitch of NP in the main scanning direction, including the liquid droplet ejection heads 50 shown in FIGS. 3B, 3C and 4. Moreover, the basic composition of the nozzle arrangement shown in FIG. 3A is taken to be representative of the nozzle arrangements such as those shown in FIGS. 3B, 3C and 4, and it is called the "projected nozzle arrangement".

Figure 6:
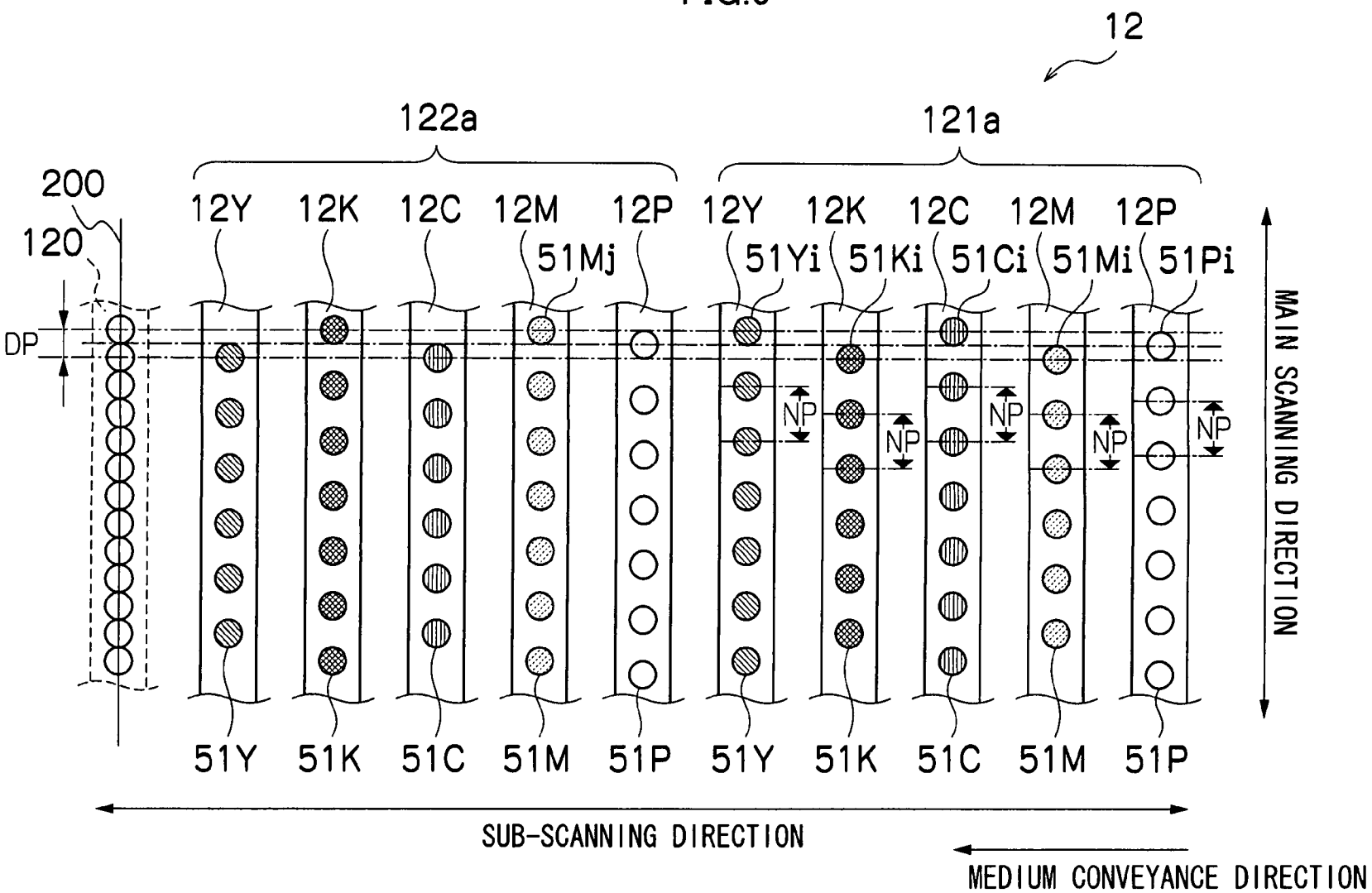
FIG. 6 is a schematic drawing showing a projected nozzle arrangement according to the first embodiment.

FIG. 6 is a schematic drawing showing a concrete projected nozzle arrangement in the liquid droplet ejection apparatus according to the first embodiment.

The interval (nozzle pitch) NP between the nozzles in the main scanning direction in the liquid droplet ejection heads 12M, 12C, 12Y, 12K and 12P is twice the interval in the main scanning direction between the dots formed on the recording medium (the recording dot pitch) DP.

Firstly, the positional relationship of the nozzles 51 in the main scanning direction, between liquid droplet ejection heads which eject inks of the same color, will be described.

The nozzles 51M belonging to the M ink ejection head 12M in the first stage 121*a* and the nozzles 51M belonging to the M ink ejection head 12M in the second stage 122*a* are disposed in such a manner that they are displaced with respect to each other by the recording dot pitch DP in the main scanning direction. In other words, looking specifically at one particular nozzle belonging to the M ink ejection head 12M in the first stage 121*a* (for example, nozzle 51Mi) and another particular nozzle 51Mj belonging to the M ink ejection head 12M in the second stage 122*a* which has the smallest difference in the main scanning direction from the particular nozzle 51Mi in the first stage 121*a*, the difference in the main scanning direction between these particular nozzles 51Mi and 51Mj is equal to the recording dot pitch DP.

More specifically, when all of the nozzles 51M ejecting magenta ink in the group of nozzles that constitute the M ink ejection head 12M of the first stage 121*a* and the group of nozzles that constitute the M ink ejection head 12M of the second stage 122*a* are projected to a single line in the main scanning direction (main scanning line) 200, then the all of the nozzles 51M complement each other to constitute one virtual nozzle line 120 having the nozzle pitch that is equal to the recording dot pitch DP in the main scanning line 200.

In a similar manner, in each of the C ink ejection heads 12C, the Y ink ejection heads 12Y, and the K ink ejection heads 12K, the nozzles are displaced with respect to each other, by the recording dot pitch DP in the main scanning direction, between the first stage 121*a* and the second stage 122*a*.

In other words, when all of the nozzles ejecting ink of the same color are projected to the main scanning line 200, then they complement each other to constitute a single virtual nozzle line 120 having the nozzle pitch that is the same as the recording dot pitch DP, on the main scanning line 200.

The nozzles 51P belonging to the treatment liquid ejection heads 12P are disposed at substantially the same position in the main scanning direction, in both the first stage 121*a* and the second stage 122*a*. In this way, the nozzles 51P of the treatment liquid ejection heads 12P in the present embodiment do not have to be displaced with respect to each other in the main scanning direction, between the first stage 121*a* and the second stage 122*a* ; however, it is also possible to achieve a uniform distribution of the treatment liquid droplets on the recording medium by displacing the nozzles 51P by the recording dot pitch DP in the main scanning direction, between the first stage 121*a* and the second stage 122*a*, similarly to the ink ejection heads 12M, 12C, 12Y and 12K.

Next, the positional relationship of the nozzles 51 in the main scanning direction is described with respect to the liquid droplet ejection heads within each of the first stage 121*a* and the second stage 122*a*.

In the same stage, the nozzles 51M belonging to the M ink ejection head 12M and the nozzles 51C belonging to the C ink ejection head 12C are disposed in such a manner that they are staggered respectively by the recording dot pitch DP in the main scanning direction. In other words, looking specifically at one particular nozzle belonging to the M ink ejection head 12M (for example, the nozzle 51Mi) and the nozzle 51Ci belonging to C ink ejection head 12C in the same stage that has the smallest difference in the main scanning direction from the particular nozzle 51Mi in the M ink ejection head 12M, the difference in the main scanning direction between these particular nozzles 51Mi and 51Ci is equal to the recording dot pitch DP.

More specifically, the nozzles 51M of the M ink ejection head 12M and the nozzles 51C of the C ink ejection head 12C in the same stage are disposed in a staggered configuration, and complement each other in such a manner that they cover all of the droplet deposition points in the main scanning direction of the projected nozzle arrangement.

Figure 7:
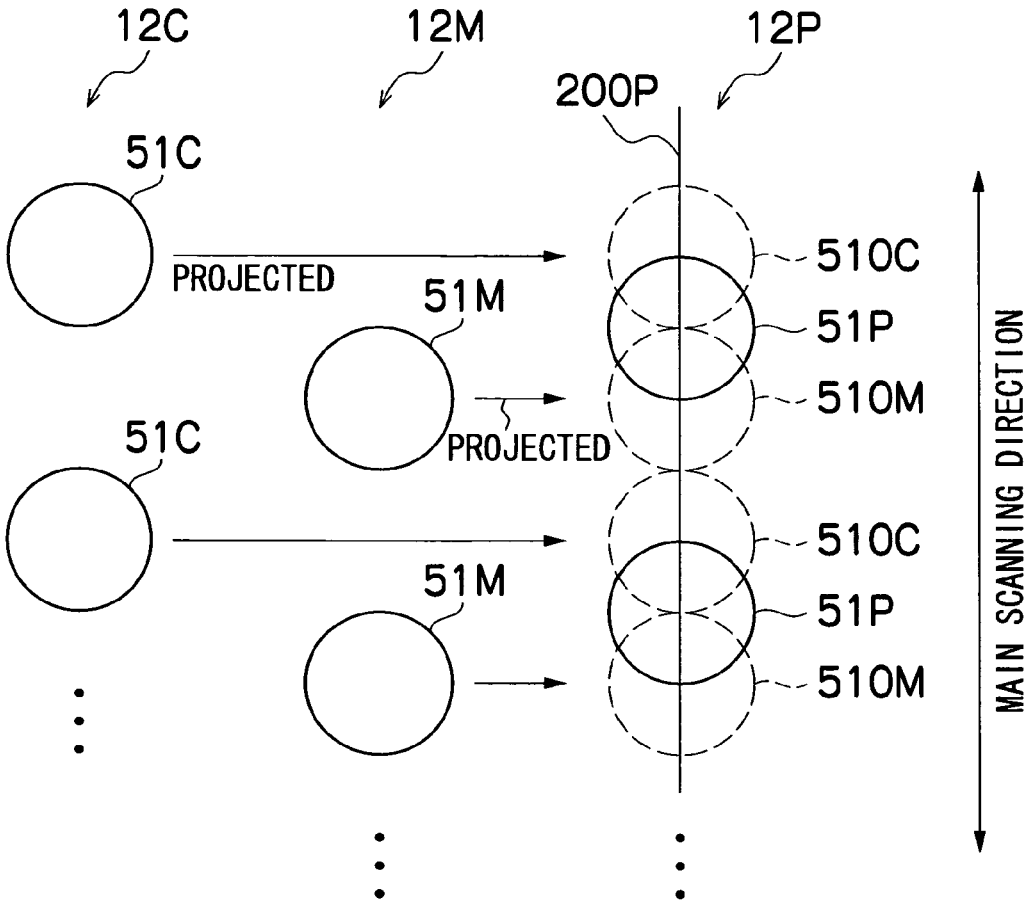
FIG. 7 is an illustrative diagram used to describe the positional relationship in the main scanning direction between a treatment liquid nozzle group and an ink nozzle group.

As shown in FIG. 7, the nozzles 51P of the treatment liquid ejection head 12P are disposed in such a manner that, when the nozzles 51M of the M ink ejection head 12M and the nozzles 51C of the C ink ejection head 12C in the same stage are projected to the single straight line (main scanning line) 200P of the treatment liquid ejection head 12P in the main scanning direction, the nozzles 51P are disposed at every other intermediate position between the projected nozzles 510M of the M ink ejection head 12M and the projected nozzles 510C of the C ink ejection head 12C that are mutually adjacent in the main scanning line 200P (in other words, the nozzles 51P are disposed at a nozzle pitch NP that is twice the recording dot pitch DP).

More specifically, in the same stage, the nozzles 51P of the treatment liquid ejection head 12P and the nozzles 51M of the M ink ejection head 12M on the downstream side thereof, are disposed in such a manner that they are displaced with respect to each other by approximately ½ of the recording dot pitch DP, in the main scanning direction. Similarly, in the same stage, the nozzles 51P of the treatment liquid ejection head 12P and the nozzles 51C of the C ink ejection head 12C on the downstream side thereof, are disposed in such a manner that they are displaced with respect to each other by approximately ½ of the recording dot pitch DP, in the main scanning direction.

In other words, within the same stage, the amount of displacement between the nozzles 51P of the treatment liquid ejection head 12P and the nozzles 51M of the M ink ejection head 12M on the downstream side thereof is substantially the same as the amount of displacement between the nozzles 51P of the treatment liquid ejection head 12P and the nozzles 51C of the C ink ejection head 12C on the downstream side thereof.

Further, in the same stage, the nozzles 51P of the treatment liquid ejection head 12P and the nozzles 51Y of the Y ink ejection head 12Y on the downstream side thereof, are disposed in such a manner that they are displaced with respect to each other by approximately ½ of the recording dot pitch, in the main scanning direction. Furthermore, in the same stage, the nozzles 51P of the treatment liquid ejection head 12P and the nozzles 51K of the K ink ejection head 12K on the downstream side thereof, are disposed in such a manner that they are displaced with respect to each other by approximately ½ of the recording dot pitch, in the main scanning direction.

Figure 8A:
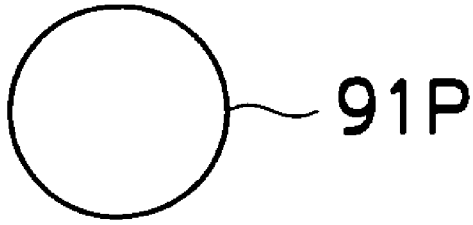
FIGS. 8A, 8B and 8C are schematic drawings showing states of deposition of treatment liquid on a recording medium, in a case where the size of the treatment liquid droplet is the same as that of the ink droplets.
Figure 8B:
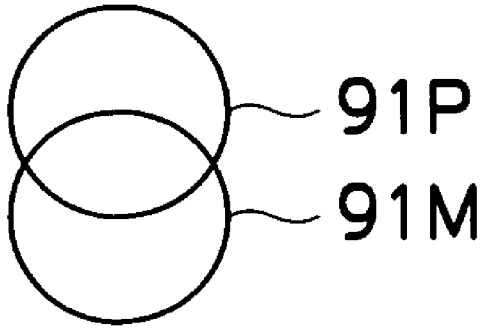
Figure 8C:
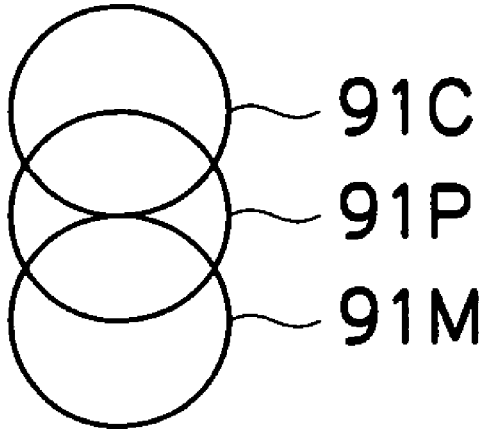

FIGS. 8A to 8C are schematic drawings showing a state of liquid droplet deposition on the recording medium when droplets are ejected onto the recording medium in the order: treatment liquid droplet, magenta ink droplet, and cyan ink droplet.

Firstly, a treatment liquid droplet 91P is deposited on the recording medium as shown in FIG. 8A by ejecting a treatment liquid droplet from a particular nozzle (51Pi in FIG. 6) of the treatment liquid ejection head 12P, whereupon a magenta ink droplet 91M is deposited onto the recording medium so as to make direct contact with the treatment liquid droplet 91P on the recording medium, as shown in FIG. 8B, by ejecting a magenta ink droplet from a particular nozzle (51Mi in FIG. 6) of the M ink ejection head 12M of the same stage located on the downstream side of the treatment liquid ejection head 12P, and then a cyan ink droplet 91C is deposited onto the recording medium so as to make direct contact with the treatment liquid droplet 91P on the recording medium, as shown in FIG. 8C, by ejecting a cyan ink droplet from a particular nozzle (51Ci in FIG. 6) of the C ink ejection head of the same stage located on the downstream side of the treatment liquid ejection head 12P.

Here, in order to simplify the description, the liquid droplets 91P, 91M and 91C on the recording medium shown in FIGS. 8A to 8C are of the same size, and it is assumed that there is no change in size during the time sequence. In actual practice, the size of the treatment liquid droplet 91P may be made larger (or smaller) than the ink droplets, by changing the ejection volume of the treatment liquid ink droplet 91P in response to the state of distribution of the ink droplets, and the like. Furthermore, in practice, the sizes of the liquid droplets 91P. 91M and 91C change in a time sequence, in accordance with the permeation of the ink droplets 91M and 91C into the recording medium, and interaction occurring between the liquid droplets on the recording medium.

After the cyan ink droplet 91C has made contact directly with the treatment liquid droplet 91P on the recording medium, if a yellow ink droplet is then ejected from a nozzle (51Yi in FIG. 6) of the Y ink ejection head 12Y of the same stage, toward the deposition position of the cyan ink droplet 91C, then the yellow ink droplet is deposited at substantially the same position as the cyan ink droplet 91C on the recording medium. However, since yellow has low visibility for human observers, then even if the yellow ink droplet does not make contact directly with the treatment liquid droplet, this has relatively little effect on the overall image, compared to the case of magenta or cyan ink droplets.

Furthermore, it is possible, in terms of the structure of liquid droplet ejection unit 12, to eject black ink from the nozzles of the K ink ejection head 12K of the same stage, after ejecting the M ink from the nozzles of the M ink ejection head 12M, but due to practical reasons, namely, the fact that the probability of a black ink droplet being deposited at the same position as a magenta ink droplet is relatively lower than the probability of a magenta ink droplet and a cyan ink droplet being deposited at the same position, or the fact that there is no possibility of a black ink droplet being deposited at the same position as a magenta ink droplet, there is little significant effect on the overall image if the nozzles 51K of the K ink head 12K are disposed at the same positions in the main scanning direction as the nozzles 51M of the M ink head 12M of the same stage.

If an image is formed by means of black ink only, without using ink other than black, such as magenta, cyan, yellow, or the like, or if black ink droplets are deposited only at positions which are different to the deposition positions of the ink droplets other than black droplets, then firstly, a treatment liquid droplet is deposited on the recording medium by ejecting treatment liquid from a nozzle (51Pi in FIG. 6, for example) of the treatment liquid ejection head 12P, whereupon a black ink droplet is deposited on the recording medium so as to make direct contact with the treatment liquid droplet on the recording medium, by ejecting a black ink droplet from a nozzle (51Ki in FIG. 6, for example) of the K ink ejection head 12K on the downstream side of the treatment liquid ejection head 12P.

Figure 9A:
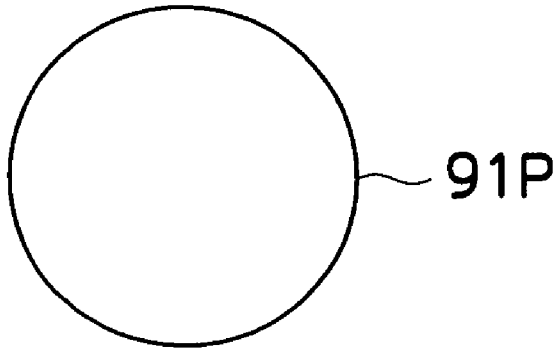
FIGS. 9A, 9B and 9C are schematic drawings showing states of deposition of treatment liquid on a recording medium, in a case where the size of the treatment liquid droplet is larger than that of the ink droplets.
Figure 9B:
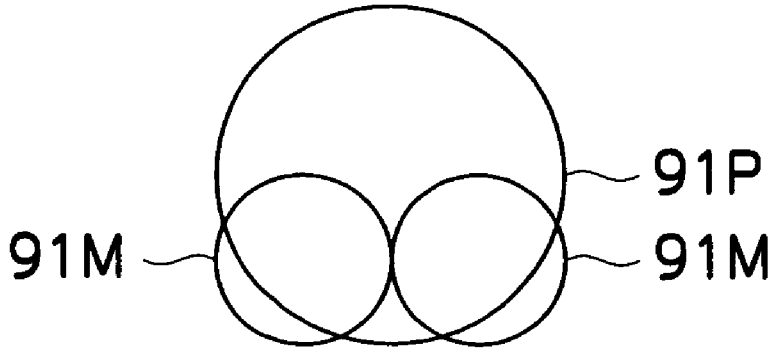
Figure 9C:
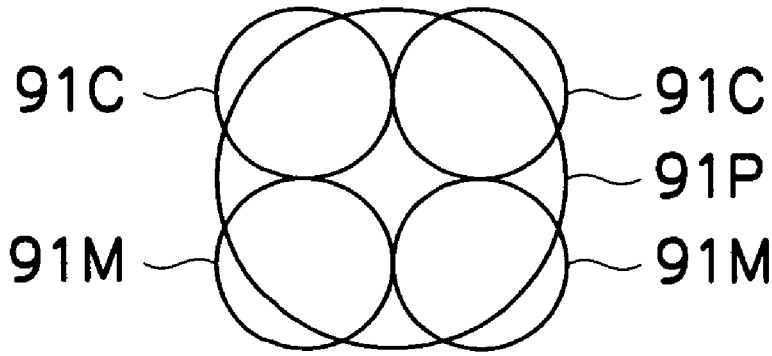

In FIGS. 8A to 8C, the size of the treatment liquid droplet when deposited on the recording medium is depicted as being of the same size of the ink droplets, but as shown in FIGS. 9A to 9C, it is also possible for the size of the treatment liquid droplet when deposited on the recording medium to be larger than the size of the ink droplets.

In FIGS. 9A to 9C, the diameter of the treatment liquid droplet 91P is shown as being approximately twice the diameter of the magenta ink droplet 91M and the diameter of the cyan ink droplet 91C.

Firstly, a treatment liquid droplet 91P is deposited on the recording medium as shown in FIG. 9A, whereupon a magenta ink droplet 91M is deposited on the recording medium so as to make direct contact with the treatment liquid droplet 91P on the recording medium, as shown in FIG. 9B, and then a cyan ink droplet 91C is deposited on the recording medium so as to make direct contact with the treatment liquid droplet 91P on the recording medium, as shown in FIG. 9C.

In the present embodiment, the ejection volume per ejection operation of the treatment liquid droplet ejected from the treatment liquid ejection head 12P is varied in accordance with the number of ink droplets ejected in the same stage, on which the treatment liquid droplets in question will act on the recording medium.

More specifically, the ejection volume is changed as described below, for example, in accordance with the number of ink droplets (namely, the number of colors) ejected from the ink ejection heads (12M, 12C, 12Y and 12K) of the same stage at positions displaced by one-half of the recording dot pitch, (DP/2) from the deposition positions of the treatment liquid droplets on the recording medium (treatment liquid dot positions).

When the ejection volume of the treatment liquid when there are four colors is taken to be "a", the ejection volume of the treatment liquid when there are three colors is "3a/4", the ejection volume of the treatment liquid when there are two colors is "2a/4", the ejection volume of the treatment liquid where there is one color is "a/4", and the ejection volume of the treatment liquid where there are 0 colors (in other words, no ink droplets are to be ejected), is "0".

For example in FIG. 6, the ejection volume of the treatment liquid from a particular nozzle 51Pi for ejecting the treatment liquid in the first stage 121*a* is "a" when ink droplets of the four colors, magenta, cyan, black and yellow are to be ejected from four of the particular ink ejection nozzles 51Mi, 51Ci, 51Ki and 12Yi in the same stage, and it is "3a/4" when ink droplets of three colors, magenta, cyan and yellow, are to be ejected from three ink ejection nozzles 51Mi, 51Ci and 12Yi, "2a/4" when ink droplets of two colors, magenta and cyan, are to be ejected from two ink ejection nozzles 51Mi and 51Ci, "a/4" when an ink droplet of one color only is to be ejected from one ink ejection nozzle 51Mi, and "0" when no ink droplets are to be ejected (if the number of colors is zero).

Next, a second embodiment of the liquid droplet ejection apparatus according to the present invention will be described.

Figure 10:
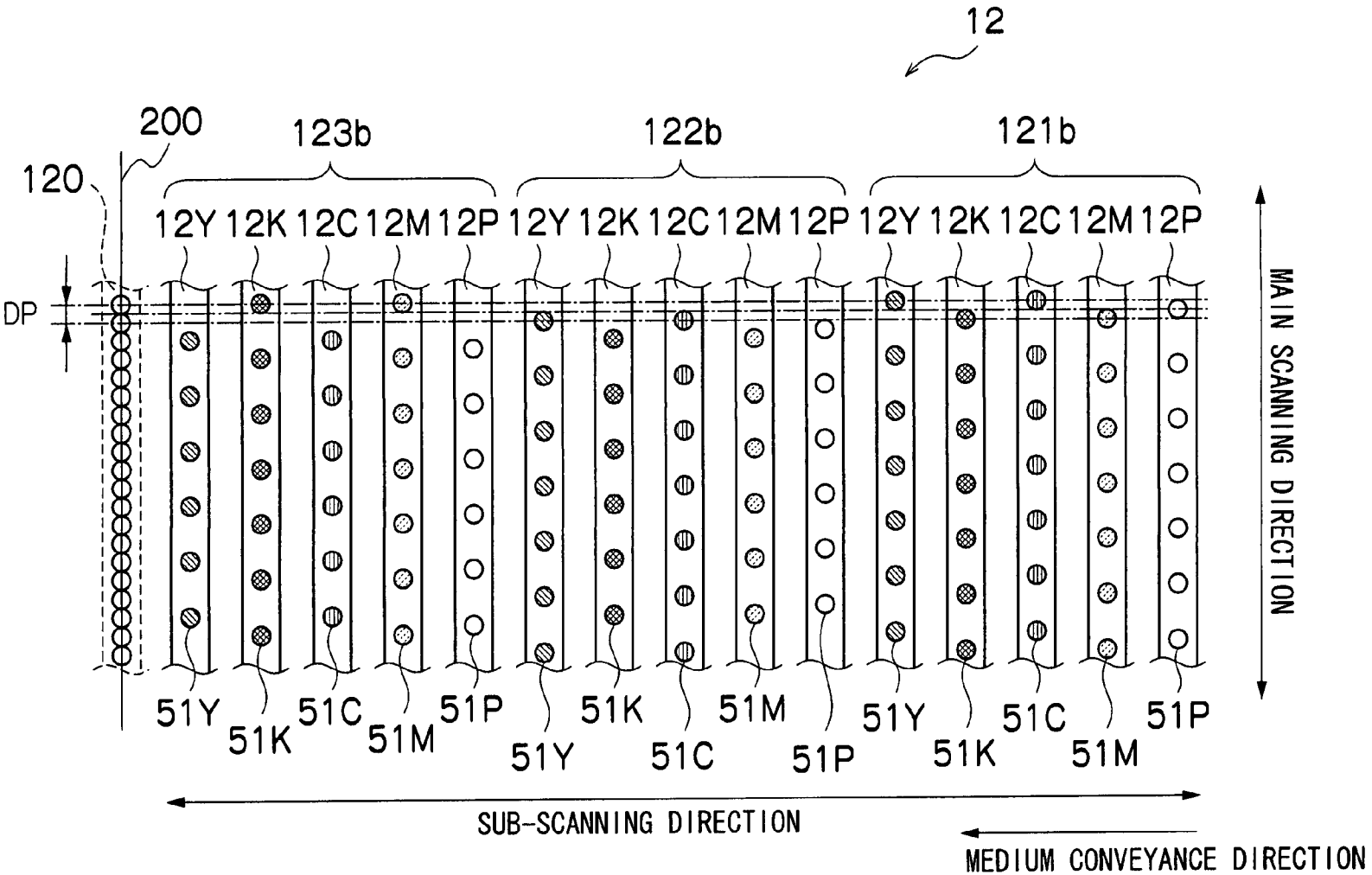
FIG. 10 is a schematic drawing showing a projected nozzle arrangement according to a second embodiment.

FIG. 10 is a schematic drawing showing a projected nozzle arrangement in a liquid droplet ejection apparatus according to the second embodiment.

Whereas the liquid droplet ejection apparatus according to the first embodiment described above has the liquid droplet ejection unit 12 that is constituted in the two stages, the first stage 121*a* and the second stage 122*a* from the upstream side in the sub-scanning direction as shown in FIG. 6; in the liquid droplet ejection apparatus according to the second embodiment, the liquid droplet ejection unit 12 is constituted in three stages, namely, a first stage 121*b*, a second stage 122*b* and a third stage 123*b*, from the upstream side in the sub-scanning direction, as shown in FIG. 10.

In each of the first stage 121*b*, the second stage 122*b* and the third stage 123*b*, the heads are disposed in the order: treatment liquid ejection head 12P, M ink ejection head 12M, C ink ejection head 12C, K ink ejection head 12K and Y ink ejection head 12Y, from the upstream side, following the sub-scanning direction.

The interval (nozzle pitch) NP between the nozzles in the main scanning direction in each of the liquid droplet ejection heads 12M, 12C, 12Y, 12K and 12P is three times the interval in the main scanning direction between the dots formed on the recording medium (the recording dot pitch) DP.

Figure 11:
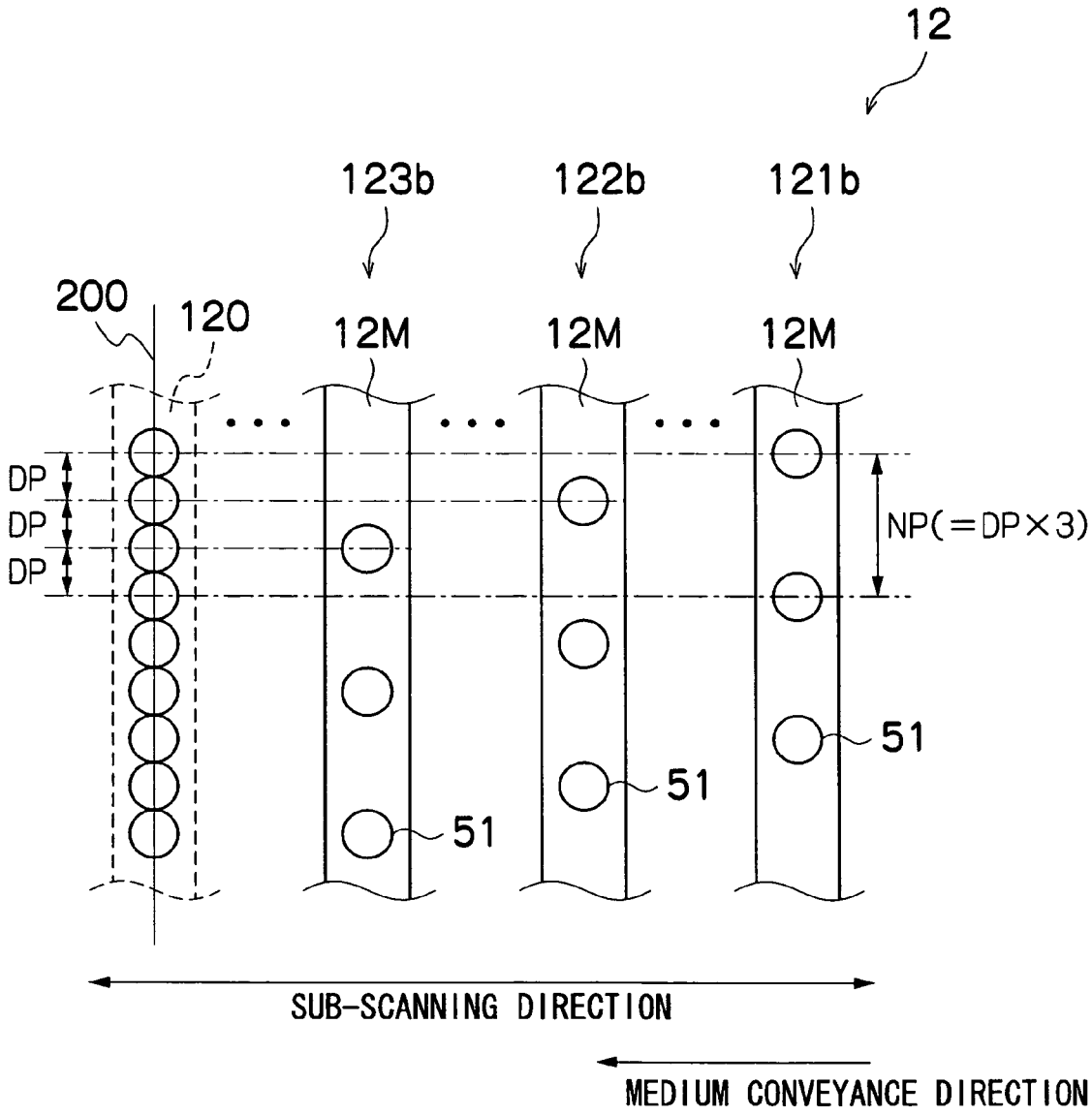
FIG. 11 is an illustrative diagram used to describe the positional relationship in the main scanning direction between ink nozzle groups of the same color, according to the second embodiment.

Looking specifically at only the M ink ejection heads 12M in the first stage 121*b*, the second stage 122*b* and the third stage 123*b*, as shown in FIG. 11, the nozzles 51M of the M ink ejection head 12M in the second stage 122*b* are disposed in positions displaced by the recording dot pitch DP in the downward direction (main scanning direction) in FIG. 11, with respect to the nozzles 51M of the M ink ejection head 12M in the first stage 121*b*. Moreover, the nozzles 51M of the M ink ejection head 12M in the third stage 123*b* are disposed in positions displaced by the recording dot pitch DP in the downward direction (main scanning direction) in FIG. 11, with respect to the nozzles 51M of the M ink ejection heads 12M in the second stage 122*b*. In a similar manner, in the C ink ejection heads 12C, the K ink ejection heads 12K, and the Y ink ejection heads 12Y, the nozzles are displaced with respect to each other, by the recording dot pitch DP in the main scanning direction, successively between the first stage 121*b* and the second stage 122*b*, and between the second stage 122*b* and the third stage 123*b*.

When all of the nozzles ejecting ink of the same color in the ink ejection heads (12M, 12C, 12K and 12Y) constituting the three stages, namely, the first stage 121*b*, the second stage 122*b* and the third stage 123*b*, are projected to a single straight line 200 in the main scanning direction (main scanning line), then the all of the nozzles complement each other to form a single virtual nozzle line 120 having a nozzle pitch equal to the recording dot pitch DP on the main scanning line 200, in such a manner that all of the droplet deposition points are covered.

Moreover, within each of the first stage 121*b*, the second stage 122*b* and the third stage 123*b*, the group of nozzles of the M ink ejection head 12M and the group of nozzles of the C ink ejection head 12C in the same stage are positioned in such a manner that that they are displaced with respect to each other by the recording dot pitch DP in the main scanning direction.

Furthermore, within each of the first stage 121*b*, the second stage 122*b* and the third stage 123*b*, the group of nozzles of the treatment liquid ejection head 12P and the group of nozzles of the M ink ejection head 12M on the downstream side thereof in the same stage, are disposed in such a manner that they are displaced with respect to each other by approximately ½ of the recording dot pitch DP, in the main scanning direction. Similarly, in the same stage, the group of nozzles of the treatment liquid ejection head 12P and the group of nozzles of the C ink ejection head 12C on the downstream side thereof, are disposed in such a manner that they are displaced with respect to each other by approximately ½ of the recording dot pitch DP, in the main scanning direction.

Hence, the amount of displacement between the nozzles 51P of the treatment liquid ejection head 12P and the nozzles 51M of the M ink ejection head 12M on the downstream side thereof is substantially the same as the amount of displacement between the nozzles 51P of the treatment liquid ejection head 12P and the nozzles 51C of the C ink ejection head 12C on the downstream side thereof.

In other words, the nozzles of the treatment liquid ejection head 12P are disposed in such a manner that, when the nozzles 51M of the M ink ejection head 12M and the nozzles 51C of the C ink ejection head 12C in the same stage are projected to the main scanning line of the treatment liquid ejection head 12P, the nozzles of the treatment liquid ejection head 12P are disposed at every third intermediate position between the projected nozzles 510M of the M ink ejection head 12M and the projected nozzles 510C of the C ink ejection head 12C that are mutually adjacent (i.e., at a nozzle pitch NP that is three times the recording dot pitch DP).

Furthermore, in the same stage, the nozzles 51P of the treatment liquid ejection head 12P and the nozzles 51Y of the Y ink ejection head 12Y on the downstream side thereof, are disposed in such a manner that they are displaced with respect to each other by approximately ½ of the recording dot pitch DP, in the main scanning direction. Similarly, in the same stage, the nozzles 51P of the treatment liquid ejection head 12P and the nozzles 51K of the K ink ejection head 12K on the downstream side thereof, are disposed in such a manner that they are displaced with respect to each other by approximately ½ of the recording dot pitch DP, in the main scanning direction.

The liquid droplet ejection apparatus according to the second embodiment, which has the projected nozzle arrangement such as that shown in FIG. 10 and described above, makes it possible to realize a small recording dot pitch by using the liquid droplet ejection heads 12M, 12C, 12Y and 12K having a large nozzle pitch, compared to the liquid droplet ejection apparatus of the first embodiment, which has the projected nozzle arrangement such as that shown in FIG. 6.

In FIG. 10, a case where the heads are composed in the three stages, the first stage 121*b*, the second stage 122*b* and the third stage 123*b*, is described as an example; however, the liquid droplet ejection apparatus according to the present invention is not limited to three stages and a composition based on four or more stages may also be adopted.

Next, a third embodiment of the liquid droplet ejection apparatus according to the present invention is described.

Figure 12:
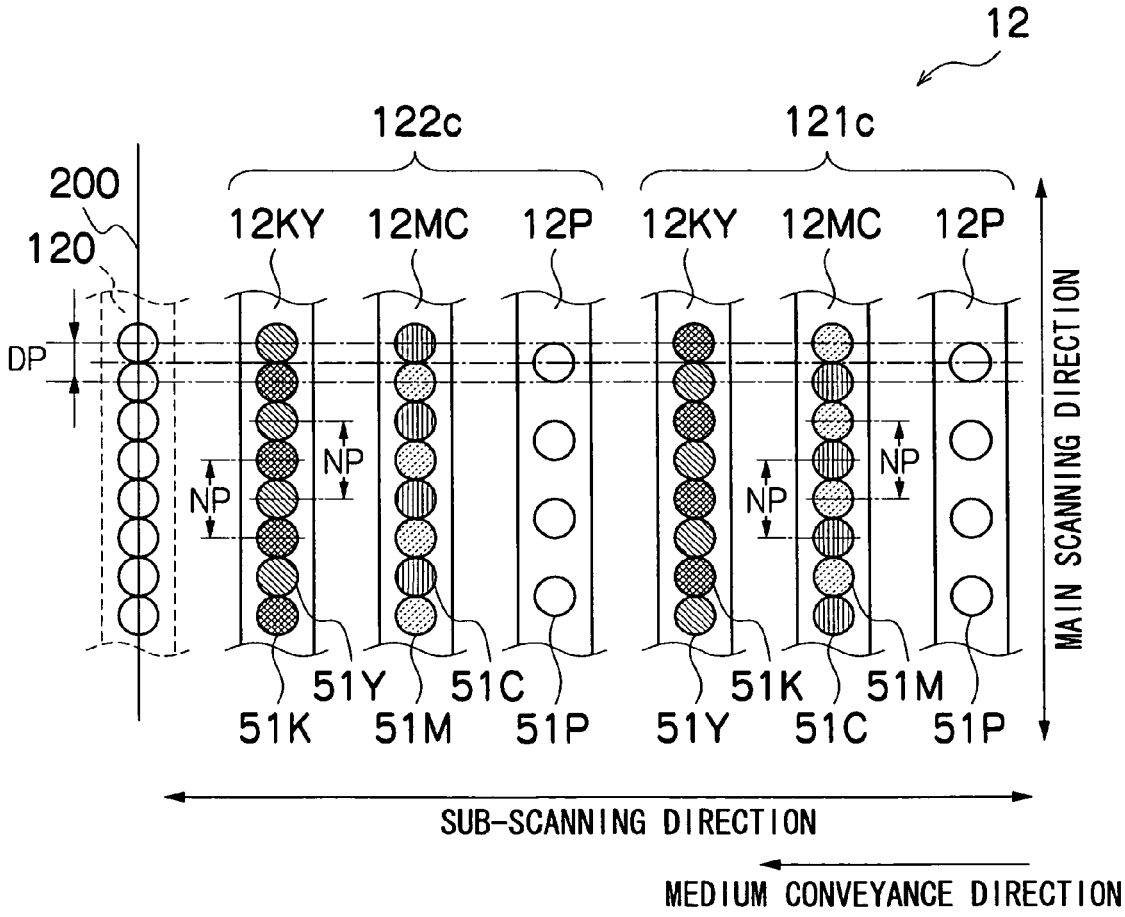
FIG. 12 is a schematic drawing showing a projected nozzle arrangement according to a third embodiment.

FIG. 12 is a schematic drawing showing a projected nozzle arrangement in a liquid droplet ejection apparatus according to the third embodiment.

Whereas the stages of the liquid droplet ejection unit 12, namely, the first stage 121*a* and the second stage 122*a*, in the liquid droplet ejection apparatus of the first embodiment described above are each constituted by the five liquid droplet ejection heads, namely, the treatment liquid ejection head 12P, the M ink ejection head 12M, the C ink ejection head 12C, the K ink ejection 12K, and the Y ink ejection head 12Y as shown in FIG. 6; in the liquid droplet ejection apparatus according to the third embodiment, the stages of the liquid droplet ejection unit 12, namely, the first stage 121*c* and the second stage 122*c*, are each constituted by three liquid droplet ejection heads, namely, a treatment liquid ejection head 12P, an MC ink ejection head 12MC, and a KY ink ejection head 12KY, as shown in FIG. 12.

In the MC ink ejection head 12MC, nozzles 51M for ejecting magenta (M) ink and nozzles 51C for ejecting cyan (C) ink are disposed in an alternating fashion on a single straight line extending in the main scanning direction.

Figure 13:
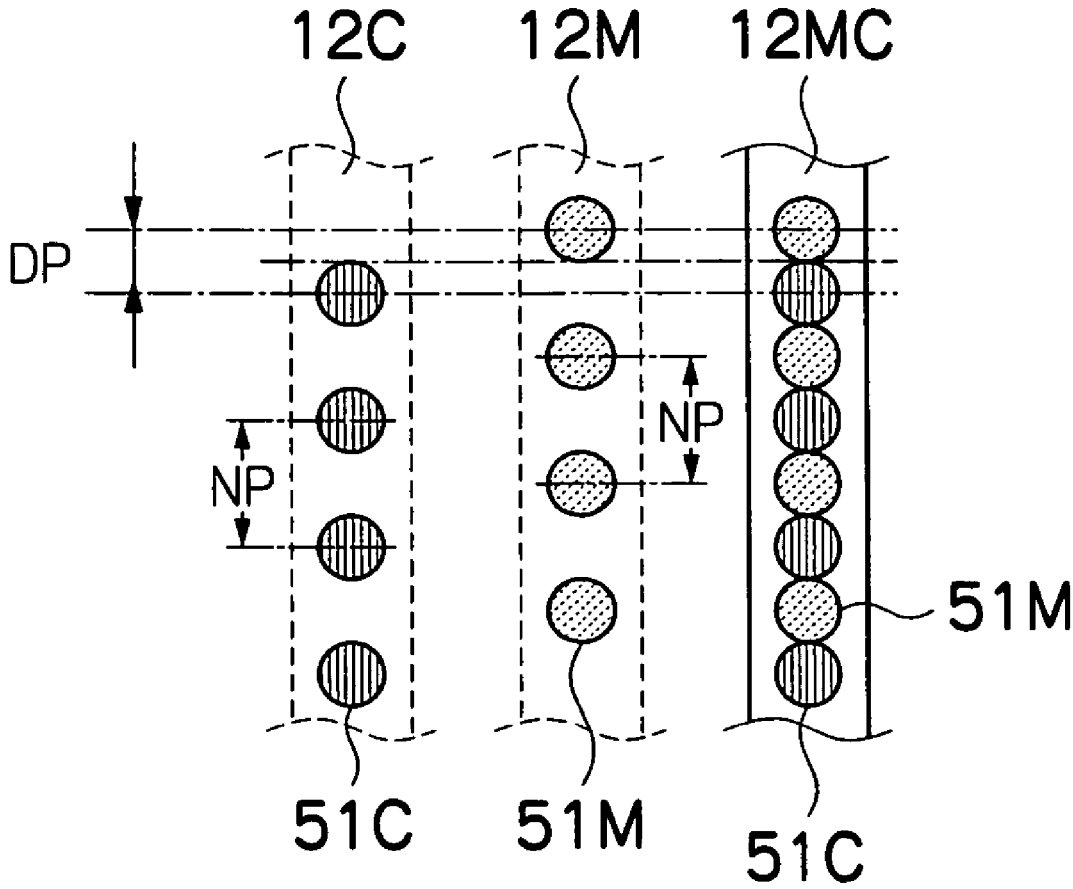
FIG. 13 is an illustrative diagram used to describe a magenta ink nozzle group and a cyan ink nozzle group in the third embodiment.

In other words, as shown in FIG. 13, the MC ink ejection head 12MC includes an M ink nozzle group 12M in which a plurality of nozzles for ejecting magenta ink are disposed in the main scanning direction, and a C ink nozzle group 12C in which a plurality of nozzles for ejecting cyan ink are disposed, the nozzle groups being positioned in such a manner that the nozzles 51M and 51C are interposed between each other alternately in the main scanning direction.

The interval between the nozzles 51M ejecting magenta ink in the MC ink ejection head 12MC, in other words, the nozzle pitch NP of the M ink nozzle group 12M is twice the recording dot pitch DP in the main scanning direction. Similarly, the interval between the nozzles 51C ejecting cyan ink in the MC ink ejection head 12MC, in other words, the nozzle pitch NP of the C ink nozzle group 12C is twice the recording dot pitch DP in the main scanning direction.

In the KY ink ejection head 12KY, nozzles 51Y for ejecting yellow (Y) ink and nozzles 51K for ejecting black (K) ink are disposed in an alternating fashion on a single straight line extending in the main scanning direction.

In the KY ink ejection head 12KY, the interval between the nozzles 51Y ejecting yellow (Y) ink, and the interval between the nozzles 51K ejecting black (K) ink, are twice the recording dot pitch DP in the main scanning direction.

Next, a fourth embodiment of the liquid droplet ejection apparatus according to the present invention will be described.

Figure 14:
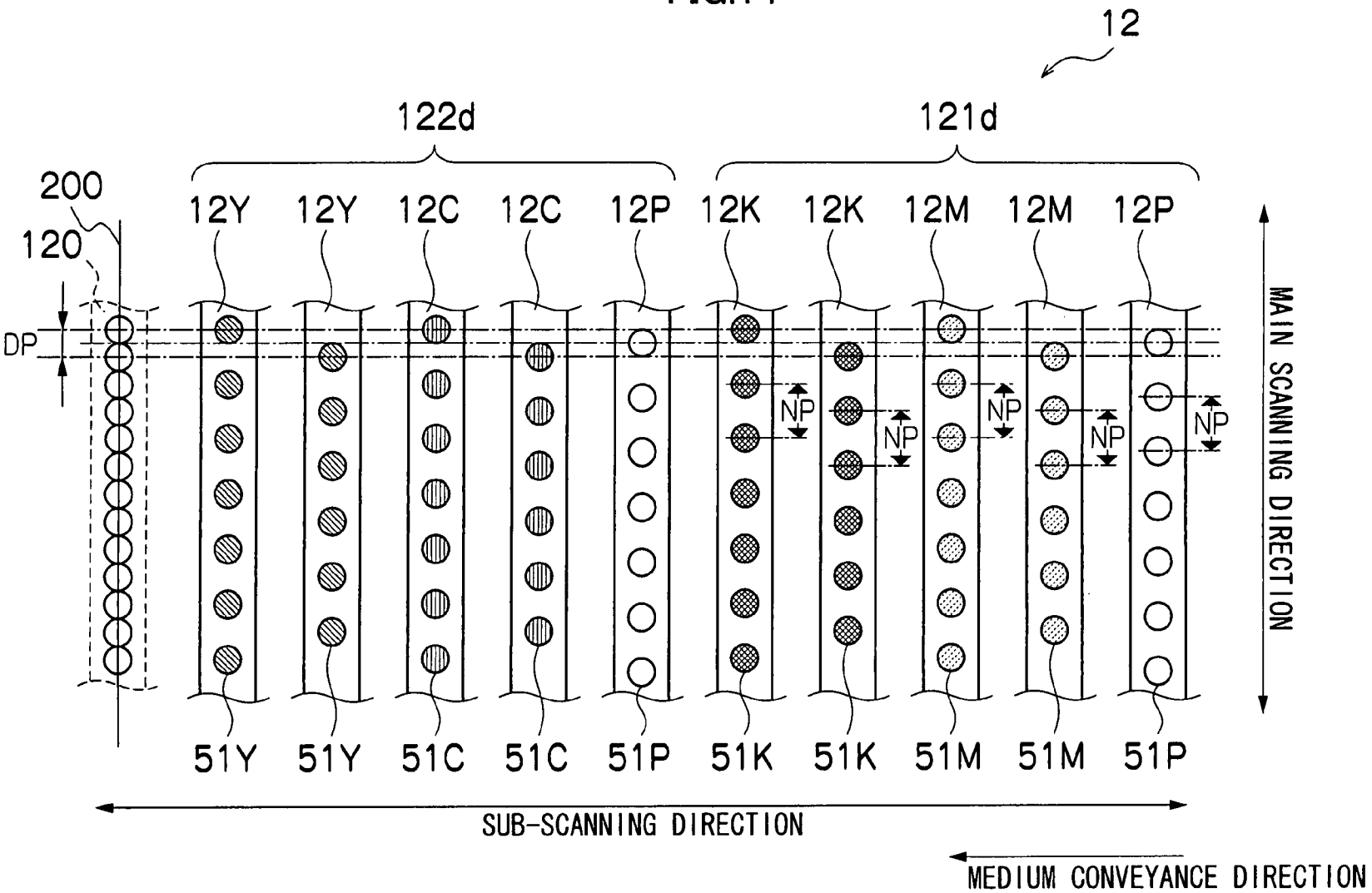
FIG. 14 is a schematic drawing showing a projected nozzle arrangement according to a fourth embodiment.

FIG. 14 is a schematic drawing showing a projected nozzle arrangement in the liquid droplet ejection apparatus according to the fourth embodiment.

Whereas in the liquid droplet ejection apparatus according to the first embodiment described above, the ink colors are arranged in the same order (M, C, K and Y) in the sub-scanning direction, in both the first stage 121*a* and the second stage 122*a* of the liquid droplet ejection unit 12, as shown in FIG. 6; in the liquid droplet ejection apparatus according to the fourth embodiment, the arrangements of the ink colors in the sub-scanning direction are different in the first stage 121*d* and the second stage 122*d* of the liquid droplet ejection unit 12 as shown in FIG. 14.

More specifically, the first stage 121*d* is composed in the following order: one treatment liquid ejection head 12P, two M ink ejection heads 12M and two K ink ejection heads 12K, from the upstream side in the sub-scanning direction. On the other hand, the second stage 122*d* is composed in the following order: one treatment liquid ejection head 12P, two C ink ejection heads 12C and two Y ink ejection heads 12Y, from the upstream side in the sub-scanning direction.

The nozzle pitch NP in the main scanning direction in each of the ink ejection heads 12M, 12C, 12Y and 12K is twice the recording dot pitch DP, and the nozzles of the ink ejection heads of the same color (namely, the nozzles 51M of the two M ink ejection heads 12M, the nozzles 51C of the two C ink ejection heads 12C, the nozzles 51Y of the two Y ink ejection heads 12Y, and the nozzles 51K of the two K ink ejection heads 12K) are disposed so as to be displaced with respect to each other by the recording dot pitch DP, in such a manner that they complement each other and cover all of the droplet deposition points in the main scanning direction.

More specifically, the two M ink ejection heads 12M of the first stage 121*d* have the nozzles 51M disposed in a staggered arrangement in the projected nozzle arrangement. Similarly, the two C ink ejection heads 12C of the second stage 122*d*, the two Y ink ejection heads 12Y of the second stage 122*d* and the two K ink ejection heads 12K of the first stage 121*d* also respectively form staggered nozzle configurations in the projected nozzle arrangement.

In other words, when all of the nozzles ejecting ink of the same color are projected to the main scanning line 200, then they constitute a single virtual nozzle line 120 having a nozzle pitch that is the same as the recording dot pitch DP, on the main scanning line 200.

More specifically, in the same stage, the nozzles 51P of the treatment liquid ejection head 12P and the nozzles 51M, 51C, 51Y or 51K of the ink ejection heads 12M, 12C, 12Y or 12K on the downstream side thereof, are disposed in such a manner that they are displaced with respect to each other by approximately ½ of the recording dot pitch DP, in the main scanning direction.

In other words, the nozzles of the treatment liquid ejection head 12P are disposed in such a manner that, when all of the nozzles of the ink ejection heads of the same color in the same stage as that treatment liquid ejection head 12P are projected to a main scanning line in the treatment liquid ejection head 12P (for example, all of the nozzles of the two M ink ejection heads 12M in the first stage 121*d*), then the nozzles of the treatment liquid ejection head 12P are disposed at every other intermediate position between the projected nozzles that are mutually adjacent in the nozzle projection (in other words, at a nozzle pitch NP which is twice the recording dot pitch DP).

In the projected nozzle arrangement shown in FIG. 14, since the ink ejection heads of the same color (for example, the two heads 12M) are disposed in sets of two in such a manner that they complement each other in the main scanning direction, then a desired recording dot pitch DP can be achieved by means of the liquid droplet ejection heads having the nozzle pitch NP that is twice the recording dot pitch DP (=DP×2). However, the present invention is not limited to this example, and a composition may also be adopted in which the desired recording dot pitch DP is achieved by one ink ejection head having a nozzle pitch equal to the recording dot pitch DP, for each color.

In a case of this kind also, in each of the first stage and the second stage, the positions of the nozzles 51P of the treatment liquid ejection head 12P in the main scanning direction lie between the positions in the main scanning direction of the nozzles that are mutually adjacent in the main scanning direction in the M ink ejection head 12M (or the C ink ejection head 51C) of the same stage. It is preferable that the nozzle pitch of the treatment liquid ejection head is twice the recording dot pitch DP.

In the above-described first to fourth embodiments, a case where one liquid droplet ejection head is constituted by one nozzle group is described as an example; however, it is also possible to adopt a composition in which one liquid droplet ejection head is constituted by integrating a plurality of nozzle groups.

For example, it is possible to compose one liquid droplet ejection head by integrating all of the nozzle groups 12P, 12M, 12C, 12K and 12Y that constitute the first stage 121*a* and the second stage 122*b* of the first embodiment shown in FIG. 6.

Furthermore, the diameters of the nozzles may be different between the group of treatment liquid nozzles and the group of ink nozzles. However, the dot size of the treatment liquid droplets needs to be sufficiently large to allow it to make at least direct contact with both the magenta ink droplets and the cyan ink droplets on the recording medium.

Furthermore, as described with reference to FIG. 3A, if nozzle groups are used in which the nozzle intervals (nozzle pitch) in the main scanning direction in the projected nozzle arrangement (in other words, the nozzle arrangement projected to a straight line in the main scanning direction), is a prescribed value NP, then the physical shape of the nozzle groups may be any of the shapes shown in FIGS. 3A, 3B, 3C and 4, or it may be a physical shape other than that shown in FIGS. 3A, 3B, 3C and 4.

Furthermore, the amount of displacement between the nozzle groups, the ratio between the nozzle pitch and the recording dot pitch, and the like, are not limited in particular to the figures used in the present specification, and needless to say, these may be changed appropriately within a range that does not deviate from the scope of the present invention.

Furthermore, the order of the ink ejection heads in the sub-scanning direction has been described as being magenta, followed by cyan, from the upstream side, but an order of cyan followed by magenta may also be used.

Moreover, the case has been described where ink droplets of the four colors, namely, magenta, cyan, yellow and black are ejected, but the present invention is not limited to the case where the ink droplets of the four colors are ejected in this way. For example, the present invention may also be applied to a case where ink droplets of six colors, including light magenta and light cyan in addition to the four colors, are ejected.

A so-called line head, in which a plurality of nozzles are aligned in the main scanning direction in the projected nozzle arrangement, has been described above; however, it is also possible to apply the present invention to a so-called shuttle head in which a plurality of nozzles are aligned in the sub-scanning direction and the nozzles are moved back and forth reciprocally in the main scanning direction.

For example, in any of the projected nozzle arrangement of the first embodiment shown in FIG. 6, the projected nozzle arrangement of the second embodiment shown in FIG. 10, the projected nozzle arrangement of the third embodiment shown in FIG. 12, and the projected nozzle arrangement of the fourth embodiment shown in FIG. 14, the liquid droplet ejection unit 12 can be constituted by interchanging the "main scanning direction" and the "sub-scanning direction" in the drawing. In this case, liquid droplets are only ejected during a forward movement in the main scanning direction.

In the shuttle head of this kind, moreover, by changing the nozzle arrangement, it is possible to eject liquid droplets during both the forward and return movements in the main scanning direction. For example, a treatment liquid nozzle group is added and the ejection of treatment liquid droplets is controlled in such a manner that the amount of treatment liquid deposited on the recording medium is not increased.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection apparatus, comprising:

a first color ink nozzle group in which a plurality of nozzles ejecting ink droplets of a first color are disposed;

a second color ink nozzle group in which a plurality of nozzles ejecting ink droplets of a second color are disposed; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of a sub-scanning direction, wherein:

the first color ink nozzle group and the second color ink nozzle group are disposed in displaced positions with respect to each other in a main scanning direction; and positions in the main scanning direction of the nozzles of the treatment liquid nozzle group lie between the positions in the main scanning direction of the nozzles of the first color ink nozzle group and the positions in the main scanning direction of the nozzles of the second color ink nozzle group.

2. A liquid droplet ejection apparatus, comprising:

a first stage of nozzle arrangement and a second stage of nozzle arrangement, the first and second stages being disposed in a sub-scanning direction, each of the first and second stages including:

a first color ink nozzle group in which a plurality of nozzles ejecting ink droplets of a first color are disposed at a nozzle pitch which is twice a recording dot pitch in a main scanning direction;

a second color ink nozzle group in which a plurality of nozzles ejecting ink droplets of a second color are disposed at the nozzle pitch which is twice the recording dot pitch in the main scanning direction; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of the sub-scanning direction, wherein, in each of the first and second stages, the nozzles of the first color ink nozzle group and the nozzles of the second color ink nozzle group are disposed so as to be mutually complementary in the main scanning direction, to cover all of droplet deposition points in the main scanning direction.

3. The liquid droplet ejection apparatus as defined in claim 2, wherein, in each of the first and second stages, the first color ink nozzle group and the second color ink nozzle group are disposed in staggered positions.

4. The liquid droplet ejection apparatus as defined in claim 2, wherein, in each of the first and second stages, the nozzles of the first color ink nozzle group and the nozzles of the second color ink nozzle group are disposed in an alternating fashion on a single straight line running in the main scanning direction.

5. The liquid droplet ejection apparatus as defined in claim 2, wherein:

positions in the main scanning direction of the nozzles of the treatment liquid nozzle group lie between positions in the main scanning direction of the nozzles of the first color ink nozzle group and positions in the main scanning direction of the nozzles of the second color ink nozzle group; and the nozzles of the treatment liquid nozzle group are disposed at a nozzle pitch which is twice the recording dot pitch in the main scanning direction.

6. A liquid droplet ejection apparatus, comprising:

n stages of nozzle arrangements, the n stages being disposed in a sub-scanning direction, each of the n stages including:

a first color ink nozzle group in which a plurality of nozzles ejecting ink droplets of a first color are disposed at a nozzle pitch which is n times a recording dot pitch in a main scanning direction;

a second color ink nozzle group in which a plurality of nozzles ejecting ink droplets of a second color are disposed at the nozzle pitch which is n times the recording dot pitch in the main scanning direction; and a treatment liquid nozzle group in which a plurality of nozzles ejecting droplets of a prescribed treatment liquid are disposed, the treatment liquid nozzle group being positioned on an upstream side of the first color ink nozzle group and the second color ink nozzle group in terms of the sub-scanning direction, wherein, in each of the n stages, the nozzles of the first color ink nozzle group and the nozzles of the second color ink nozzle group are disposed so as to be displaced with respect to each other by the recording dot pitch in the main scanning direction.

7. The liquid droplet ejection apparatus as defined in claim 6, wherein the nozzles of the first color ink nozzle group and the second color ink nozzle group are disposed so as to be mutually complementary to form, when all of the nozzles in the n stages that eject ink of a same color are projected to a straight line running in the main scanning direction, a single virtual nozzle line on the straight line having a nozzle pitch equal to the recording dot pitch.

8. The liquid droplet ejection apparatus as defined in claim 6, wherein:

positions in the main scanning direction of the nozzles of the treatment liquid nozzle group lie between positions in the main scanning direction of the nozzles of the first color ink nozzle group and positions in the main scanning direction of the nozzles of the second color ink nozzle group; and the nozzles of the treatment liquid nozzle group are disposed at a nozzle pitch which is n times the recording dot pitch in the main scanning direction.

9. A liquid droplet ejection apparatus, comprising:

a first stage having an ink nozzle group in which a plurality of nozzles ejecting ink droplets of a first color are disposed; and a second stage having an ink nozzle group in which a plurality of nozzles ejecting ink droplets of a second color we disposed, wherein:

in each of the first and second stages, a treatment liquid nozzle group in which a plurality of nozzles ejecting droplets of a prescribed treatment liquid are disposed are provided on an upstream side of the ink nozzle group in the stage in terms of a sub-scanning direction; and in each of the first and second stages, positions in a main scanning direction of the nozzles of the treatment liquid nozzle group lie between positions in the main scanning direction of the nozzles that are mutually adjacent in the main scanning direction in the ink nozzle groups of the same stage.

10. The liquid droplet ejection apparatus as defined in claim 9, wherein:

in each of the first and second stages, the ink nozzle group is disposed by being divided into two ink nozzle sub-groups in the sub-scanning direction; and in each of the first and second stages, the positions in the main scanning direction of the nozzles of the treatment liquid nozzle group lie between the positions in the main scanning direction of the nozzles belonging to one of the two ink nozzle sub-groups in the same stage, and the positions in the main scanning direction of the nozzles belonging to the other of the two ink nozzle sub-groups in the same stage.

* * * * *